US007715756B2

(12) United States Patent
Hattori

(10) Patent No.: US 7,715,756 B2
(45) Date of Patent: May 11, 2010

(54) IMAGE FORMING APPARATUS WITH LINEAR MOVEMENT MEMBER

(75) Inventor: Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 678 days.

(21) Appl. No.: 11/614,392

(22) Filed: Dec. 21, 2006

(65) Prior Publication Data

US 2007/0147887 A1 Jun. 28, 2007

(30) Foreign Application Priority Data

Dec. 27, 2005 (JP) ..... 2005-376117

(51) Int. Cl.
*G03G 15/08* (2006.01)

(52) U.S. Cl. ..... 399/119

(58) Field of Classification Search ..... 399/119
See application file for complete search history.

(56) References Cited

FOREIGN PATENT DOCUMENTS

| | | |
|---|---|---|
| JP | 9-304994 | 11/1997 |
| JP | 2002-006716 | 1/2002 |
| JP | 2004-020855 | 1/2004 |
| JP | 2004-264791 | 9/2004 |
| JP | 2005-157112 | 6/2005 |

OTHER PUBLICATIONS

Machine translation of JP 2005-157112 A.*
Notification of Reasons for Refusal for Japanese Application 2005-376117; Mailing Date May 7, 2009.

* cited by examiner

*Primary Examiner*—David M Gray
*Assistant Examiner*—Ruth N Labombard
(74) *Attorney, Agent, or Firm*—Banner & Witcoff, Ltd.

(57) ABSTRACT

An image forming apparatus that includes: an image carrier on which an electrostatic latent image is formed; a developing agent carrier which supplies developing agent to the image carrier; a linear movement member which reciprocally and substantially linearly moves between a pressing position for pressing the developing agent carrier against the image carrier and a releasing position for releasing pressure; a drive source; a cover which is provided on a body of the apparatus so as to be opened and closed; a first input member which inputs a driving force from the drive source to the linear movement member as a force for moving the linear movement member; and a second input member which inputs a force for moving the linear movement member in conjunction with an opening motion of the cover.

11 Claims, 26 Drawing Sheets

IMAGE FORMING APPARATUS WITH LINEAR MOVEMENT MEMBER

CROSS-REFERENCE TO RELATED APPLICATION

This application claims priority from Japanese Patent Application No. 2005-376117, filed Dec. 27, 2005, the entire contents of which are hereby incorporated by reference into the present application.

TECHNICAL FIELD

Aspects of the present invention relate to an image forming apparatus such as a laser printer.

BACKGROUND

An image forming apparatus of electro-photographic system such as a laser printer is generally provided with a photosensitive drum on which an electrostatic latent image is formed. A developing cartridge for developing the electrostatic latent image into a toner image is detachably mounted to the image forming apparatus.

A cover is provided on a body of the apparatus so as to be opened/closed. By opening this cover, the developing cartridge can be mounted to and detached from the apparatus body.

The developing cartridge is provided with a developing roller for supplying toner to the photosensitive drum. This developing roller can be pressed against or separated from the photosensitive drum in a state where the developing cartridge has been mounted to the apparatus body.

As a structure for allowing the developing roller to be pressed against or separated from the photosensitive drum, a structure including a lever for pressing a developing unit which holds the developing roller, a guide member for operating the lever, and a guide cam for rendering this guide member to reciprocally and linearly move has been proposed (see JP-A-2002-6716, for example). When an image is to be formed, the guide member is moved in one direction following rotation of the guide cam, and the lever is separated from the developing unit, whereby the developing roller is pressed against the photosensitive drum. On the other hand, when an image is not formed, the guide member is moved in the other direction following the rotation of the guide cam, so that the lever presses the developing unit, whereby the developing roller is separated from the photosensitive drum.

SUMMARY

In the conventional image forming apparatus, when the developing cartridge is to be detached from the apparatus body by opening the cover, the developing roller is not necessarily separated from the photosensitive drum. In some cases, the developing roller is kept pressed against the photosensitive drum. For example, in case where electric power is suddenly cut off during image forming operation or immediately after the image forming operation has finished, the developing roller is kept in the state pressed against the photosensitive drum. When the developing cartridge is detached from the apparatus body, smooth detaching operation of the developing cartridge may not be attained, in case where the developing roller is kept pressed against the photosensitive drum.

Aspects of the invention provide an image forming apparatus in which pressure of a developing agent carrier against an image carrier is removed when a cover is opened.

DETAILED DESCRIPTION

General Overview

Figure 1:
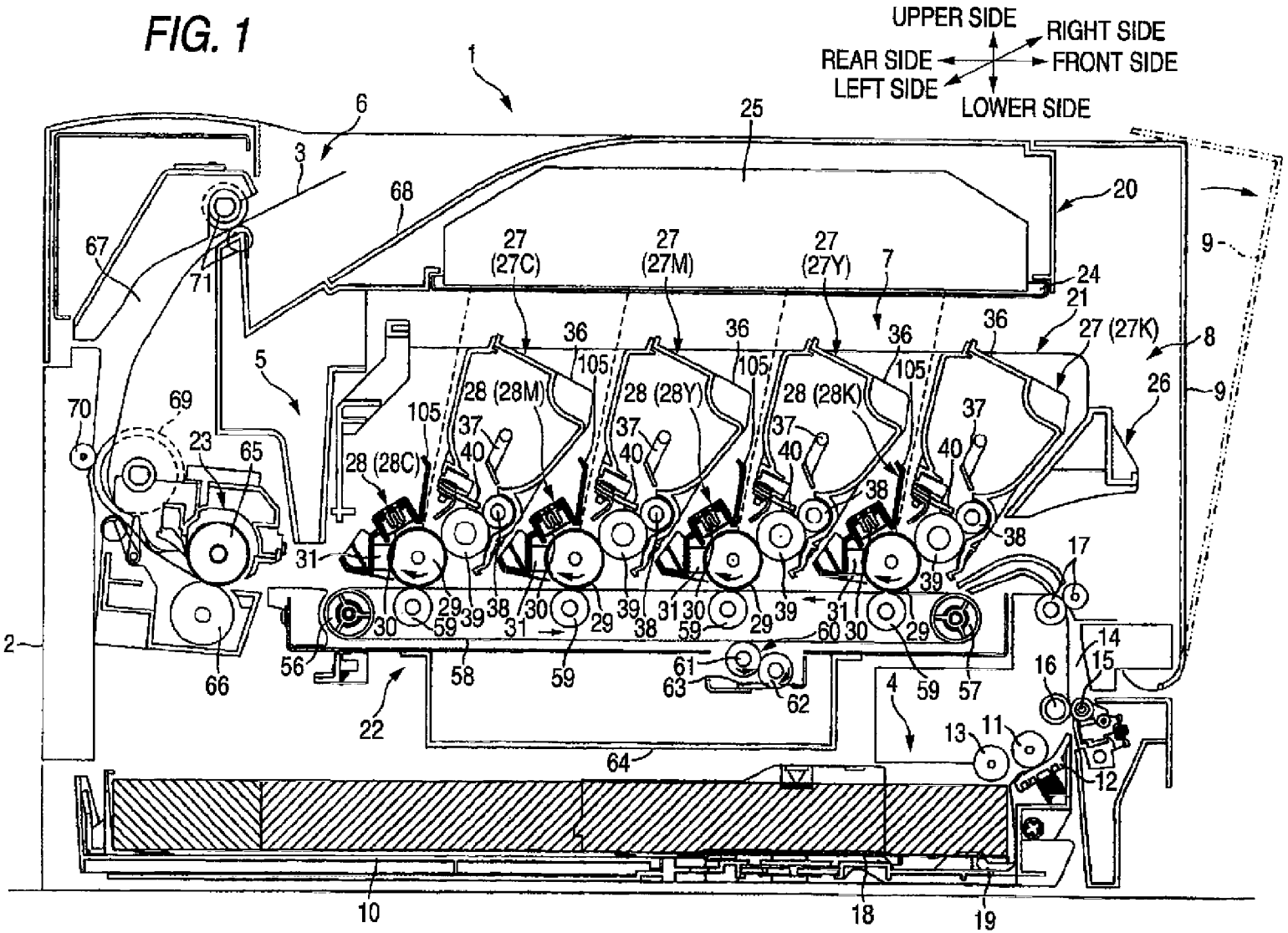
FIG. 1 is a sectional side view showing a color laser printer according to an aspect of the invention.

According to a first aspect of the invention, there is provided an image forming apparatus comprising: an image carrier on which an electrostatic latent image is formed; a developing agent carrier which supplies developing agent to the image carrier; a linear movement member which reciprocally and substantially linearly moves between a pressing position for pressing the developing agent carrier against the image carrier and a releasing position for releasing pressure; a drive source; a cover which is provided on a body of the apparatus so as to be opened and closed; a first input member which inputs a driving force from the drive source to the linear movement member as a force for moving the linear movement member; and a second input member which inputs a force for moving the linear movement member in conjunction with an opening motion of the cover.

According to the above described structure, while the cover is closed, it is possible to press the developing agent carrier against the image carrier or to release the pressure, by inputting the driving force from the drive source to the linear movement member by way of the first input member thereby to move the linear movement member between the pressing position and the releasing position. Moreover, because the linear movement member is moved to the releasing position by the force inputted to the linear movement member by way of the second input member in association with the opening motion of the cover, the pressure of the developing agent carrier against the image carrier can be released, in the state where the cover is opened. For this reason, the developing cartridge can be smoothly detached from the apparatus body, even in a structure where the developing agent carrier is provided in a developing cartridge which is detachably mounted to the apparatus body.

According to a second aspect of the invention, the linear movement member is integrally provided with a first rack gear and a second rack gear, the first input member includes a first input gear which inputs the driving force from the drive source to the first rack gear, and the second input member includes a second input gear which inputs the force for moving the linear movement member to the second rack gear.

According to the above described structure, because the first rack gear and the second rack gear are integrally provided on the linear movement member, it is possible to reliably move the linear movement member by the force inputted to the first rack gear by way of the first input gear, and also possible to reliably move the linear movement member by the force inputted to the second rack gear by way of the second input gear. In this manner, pressure of the developing agent carrier against the image carrier can be reliably exerted and released.

According to a third aspect of the invention, the image forming apparatus further comprises a first clutch mechanism capable of being switched to a transmission state in which the driving force from the drive source is transmitted to the first input gear and to an interruption state in which transmission of the driving force to the first input gear is interrupted.

According to the above described structure, the transmission and interruption of the driving force from the drive source to the first input gear can be switched by the first clutch mechanism. Therefore, it is possible to transmit the driving force from the drive source to the first input gear, and to move the linear movement member by the driving force. It is also possible to interrupt the driving force from the drive source to the first input gear, and to move the linear movement member by the force which is inputted from the second input gear to the second rack gear, irrespective of the drive source. In other words, in case where the linear movement member is moved by the driving force of the drive source, the driving force is transmitted to the first input gear, and in other cases, connection between the drive source and the first input gear is interrupted, whereby it is possible to prevent the drive source from hindering the movement of the linear movement member.

According to a fourth aspect of the invention, the image forming apparatus further comprises a clutch switching lever which switches the first clutch mechanism from the interruption state to the transmission state in conjunction with a closing motion of the cover and switches the first clutch mechanism from the transmission state to the interruption state in conjunction with the opening motion of the cover.

According to the above described structure, because the first clutch mechanism can be switched to the transmission state in association with the closing motion of the cover, it is possible to move the linear movement member thereafter, by the driving force from the drive source. Moreover, because the first clutch mechanism can be switched to the interruption state in association with the opening motion of the cover, it is possible to move the linear movement member thereafter, by the driving force inputted to the second rack gear by way of the second input gear, irrespective of the drive source.

According to a fifth aspect of the invention, the first clutch mechanism includes: a gear support shaft; a drive input gear capable of rotating about the gear support shaft, the drive input gear including an input gear portion and a sun gear portion which are formed on a coaxial cylindrical face around the gear support shaft, the driving force from the drive source being inputted to the input gear portion; a drive output gear capable of rotating about the gear support shaft, the drive output gear including an output gear portion which is formed on a cylindrical face around the gear support shaft and an inner gear portion which is formed on a cylindrical face opposed to the sun gear portion leaving a space, the first input gear being meshed with the output gear portion; a planetary gear which is interposed between the sun gear portion and the inner gear portion and is meshed with the sun gear portion and the inner gear portion; and a planetary gear base member including a planetary gear support portion which is arranged between the drive input gear and the drive output gear and is rotatable about the gear support shaft, the planetary gear support portion rotatably supporting the planetary gear, wherein the clutch switching lever is engaged with the planetary gear base member in conjunction with the closing motion of the cover and is separated from the planetary gear base member in conjunction with the opening motion of the cover.

According to the above described structure, in a state where the clutch switching lever is locked to the planetary gear base member, the rotation of the planetary gear base member is restricted. Therefore, when the drive input gear is rotated, the planetary gear will rotate on its own axis without changing its position in the circumferential direction around the gear support shaft. Due to the rotation of the planetary gear, the drive output gear having the inner gear portion which is meshed with the planetary gear is rotated around the gear support shaft. On the other hand, in a state where the clutch switching lever is separated from the planetary gear base member, the planetary gear base member can be rotated around the gear support shaft. Therefore, even though the driving force from the drive source is inputted to the drive input gear, the rotation force of the drive input gear will not be transmitted to the drive output gear, because the planetary gear will revolve around the gear support shaft (the planetary gear base member rotates around the gear support shaft), while the planetary gear rotates on its own axis. As the results, in the state where the cover is closed, it is possible to reliably transmit the driving force from the drive source to the first input gear which is meshed with the output gear part of the drive output gear. On the other hand, in the state where the cover is opened, it is possible to reliably interrupt the transmission of the driving force from the drive source to the first input gear.

According to a sixth aspect of the invention, the second input gear rotates in conjunction with the opening motion and the closing motion of the cover.

According to the above described structure, it is possible to generate the rotation force of the second input gear in association of the opening motion and the closing motion of the cover.

According to a seventh aspect of the invention, the image forming apparatus further comprises a second clutch mechanism capable of being switched to a transmission state, in which rotation force of the second input gear is transmitted to the second rack gear, and to an interruption state, in which transmission of the rotation force of the second input gear to the second rack gear is interrupted.

According to the above described structure, it is possible to switch the transmission and interruption of the rotation force of the second input gear to the second rack gear by the second clutch mechanism. In this manner, it is possible to transmit the rotation force of the second input gear to the second rack gear thereby to move the linear movement member. On the other hand, it is possible to input the driving force from the drive source to the first rack gear, interrupting the transmission of the rotation force of the second input gear to the second rack gear, thereby to move the linear movement member.

According to an eighth aspect of the invention, the second clutch mechanism is capable of being switched from the interruption state to the transmission state during the opening motion of the cover and being switched from the interruption state to the transmission state during the closing motion of the cover.

According to the above described structure, it is possible to switch the second clutch mechanism to the transmission state during the opening motion of the cover, and to transmit the rotation force of the second input gear to the second rack gear thereby to move the linear movement member. By rendering the linear movement member to move from the pressure exerting position to the releasing position by the rotation force of the second input gear at this time, the pressure of the developing agent carrier against the image carrier can be reliably removed. On the other hand, because the second clutch mechanism can be switched to the interruption state during the closing motion of the cover, it is possible to move the linear movement member to the pressure exerting position and the releasing position after the closing motion, by inputting the driving force from the drive source to the first rack gear.

According to a ninth aspect of the invention, the second clutch mechanism includes: a rotary gear which is meshed with the second input gear and is rotated in one direction in conjunction with the opening motion of the cover, the rotary gear being rotated in the other direction opposite to the one direction in conjunction with the closing motion of the cover; and a swinging arm which rotatably supports the second input gear and is moved, following the rotation of the rotary gear in the one direction, from a separated position in which the second input gear is separated from the second rack gear to a meshed position in which the second input gear is meshed with the second rack gear, the swinging arm being moved from the meshed position to the separated position, following the rotation of the rotary gear in the other direction.

According to the above described structure, the rotary gear is rotated in one direction in association with the opening motion of the cover, and following this rotation, the second input gear is meshed with the second rack gear while rotating. Accordingly, it is possible to reliably transmit the rotation force of the second input gear to the second rack gear during the opening motion of the cover. Moreover, the rotary gear is rotated in the other direction in association with the closing motion of the cover, and following this rotation, the second input gear is separated from the second rack gear. Accordingly, it is possible to reliably interrupt the transmission of the rotation force of the second input gear to the second rack gear during the closing motion of the cover.

According to a tenth aspect of the invention, the second input gear is meshed with the second rack gear in conjunction with the opening motion of the cover, thereby to input the force for moving the linear movement member to the releasing position to the second rack gear.

According to the above described structure, it is possible to move the linear movement member to the releasing position by the force which is inputted from the second input gear to the second rack gear in association with the opening motion of the cover. Accordingly, in the state where the cover is opened, it is possible to reliably remove the pressure of the developing agent carrier against the image carrier.

According to an eleventh aspect of the invention, when the linear movement member is moved to the releasing position, engagement between the second input gear and the second rack gear is released.

According to the above described structure, after the linear movement member has been moved to the releasing position, it is possible to prevent the force for moving the linear movement member from being inputted from the second input gear to the second rack gear. Therefore, it is possible to prevent the linear movement member from moving beyond the releasing position, and to prevent occurrence of troubles due to such excessive movement of the linear movement member.

Illustrative Aspects

1. General Structure of a Color Laser Printer

FIG. 1 is a sectional side view showing a color laser printer as an image forming apparatus according to an aspect of the invention.

This color laser printer 1 is of a laterally disposed tandem type in which a plurality of drum subunits 28 which will be described below are arranged in parallel in a horizontal direction. The color laser printer 1 includes, in a body casing 2, a sheet supply section 4 for supplying a sheet 3, an image forming section 5 for forming an image on the sheet 3 which has been supplied, and a sheet discharge section 6 for discharging the sheet 3 on which the image has been formed.

(1) Body Casing

The body casing 2 has a shape of a substantially rectangular box in a side view. A drum containing space 7 for containing a drum unit 26, which will be described below, is defined inside the body casing 2.

A mounting hole 8 communicated with the drum containing space 7 is formed on one side face of the body casing 2. A front cover 9 as a cover for opening or closing the mounting hole 8 is provided on the side face where the mounting hole 8 is formed. This front cover 9 is tilted sideward from the body casing 2 thereby to open the mounting hole 8 and is erected along the one side face of the body casing 2 thereby to close the mounting hole 8. The drum unit 26 can be mounted to and detached from the drum containing space 7 through the mounting hole 8, in a state where the mounting hole 8 is opened.

In the following description, the side where the front cover 9 is provided (the right side in FIG. 1) is referred to as a front side, and the opposite side (the left side in FIG. 1) is referred to as a rear side. Moreover, right and left are so defined, when the color laser printer 1 is seen from the front side. Further, the front and rear, the right and left, and the upper and lower sides of the drum unit 26 and the developing cartridge 27 are so defined, in a state where they are contained in the body casing 2, unless particularly described.

(2) Sheet Supply Section

The sheet supply section 4 is provided in a bottom part of the body casing 2. This sheet supply section 4 includes a sheet supply tray 10 which stores the sheet 3, a separating roller 11 and a separating pad 12 which are provided above a front end of the sheet supply tray 10 so as to be opposed to each other, a sheet supply roller 13 which is provided behind the separating roller 11, and a sheet supply path 14 through which the sheet 3 passes.

The sheet supply path 14 is formed in a substantially U-shape in a side view, in such a manner that its upstream end is adjacent to the separating roller 11 and its downstream end is adjacent to a conveying belt 58 from a front side of the conveying belt 58. The conveying belt 58 will be described below.

In the middle of the sheet conveying path 14, a paper dust removing roller 15 and a pinch roller 16 are provided above a front side of the separating roller 11 so as to be opposed to each other. A pair of register rollers 17 are provided above the paper dust removing roller 15 and the pinch roller 16.

A sheet press plate 18 on which the sheets 3 are mounted in a stacked manner is provided inside the sheet supply tray 10. This sheet press plate 18 is tiltably held at its rearward end so as to move between a sheet mount position in which the sheet press plate 18 lies along a bottom plate of the sheet supply tray 10 with its forward end tilted downward, and a sheet supply position in which the sheet press plate 18 is inclined with its forward end tilted upward.

In addition, a lever 19 for lifting the forward end of the sheet press plate 18 upward is provided below a forward end part of the sheet supply tray 10. This lever 19 is held below the forward end of the sheet press plate 18 so as to be tilted in a vertical direction.

By tilting the lever 19, the forward end of the sheet press plate 18 is lifted upward, whereby the sheet press plate 18 is positioned in the sheet supply position.

When the sheet press plate 18 is positioned in the sheet supply position, the uppermost sheet of the sheet 3 on the sheet press plate 18 is pressed against the sheet supply roller 13, and the uppermost sheet is supplied, with rotation of the sheet supply roller 13, to a position between the separating roller 11 and the separating pad 12.

When the sheet supply tray 10 is withdrawn from the body casing 2, the sheet press plate 18 is positioned in the sheet mount position. When the sheet press plate 18 is positioned in the sheet mount position, it is possible to mount the sheets 3 on the sheet press plate 18 in a stacked manner.

The sheet 3 which has been supplied is caught between the separating roller 11 and the separating pad 12 and is separated one by one to be conveyed. The sheet 3 which has been conveyed passes between the paper dust removing roller 15 and the pinch roller 16, and paper dust is removed. Thereafter, the sheet 3 is conveyed to the register rollers 17 along the sheet conveying path 14.

The sheet 3 is conveyed to the conveying belt 58 after it has been registered by the register rollers 17.

(3) Image Forming Section

The image forming section 5 includes a scanner part 20, a process part 21, a transfer part 22, and a fixing part 23.

(3-1) Scanner Part

The scanner part 20 is arranged in an upper part of the body casing 2. This scanner part 20 has a support plate 24 which extends longitudinally and laterally, and a scanner unit 25 which is fixed on an upper face of the support plate 24. In the scanner unit 25, optical members such as four light sources, a polygon mirror, an fθ lens, a reflection mirror, a plane inclination correcting lens are arranged. Laser beams based on image data which have been emitted from the respective light sources are deflected and scanned by the polygon mirror, pass the fθ lens and the plane inclination correcting lens, and then are reflected by the reflection mirror. Thereafter, the beams are irradiated by rapid scanning onto surfaces of photosensitive drums 29 for respective colors, which will be described below.

(3-2) Process Part

The process part 21 is arranged below the scanner part 20 and above the sheet supply section 4. The process part 21 includes the single drum unit 26, and the four developing cartridges 27 corresponding to the respective colors.

(3-2-1) Drum Unit

The drum unit 26 has the four drum sub-units 28 corresponding to the respective colors, namely, a black drum sub-unit 28K, an yellow drum sub-unit 28Y, a magenta drum sub-unit 28M, and a cyan drum sub-unit 28C.

The drum sub-units 28 are arranged in parallel at intervals in a front-rear direction. More specifically, the black drum sub-unit 28K, the yellow drum sub-unit 28Y, the magenta drum sub-unit 28M, and the cyan drum sub-unit 28C are arranged in this order from the front side toward the rear side.

As described below, each of the drum sub-units 28 includes a pair of side frames 104 and a center frame 105 which is bridged between them (See FIG. 4).

Figure 2:
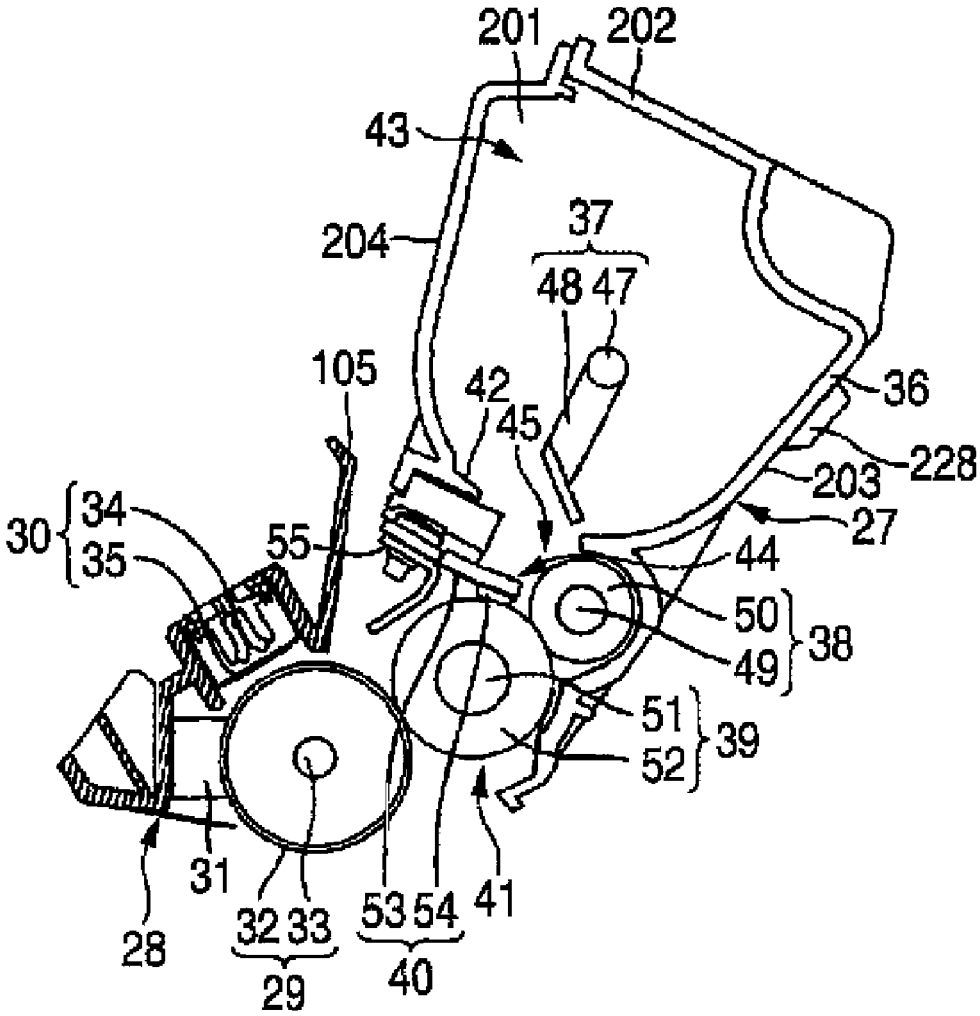
FIG. 2 is a sectional side view showing a developing cartridge and a drum sub-unit shown in FIG. 1.
Figure 2:
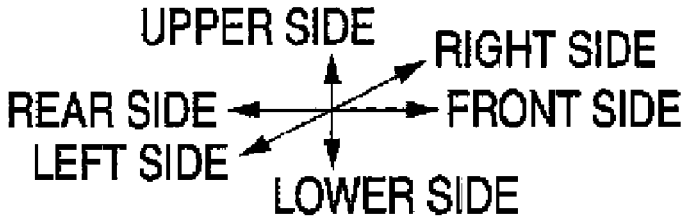

FIG. 2 is a sectional side view showing the developing cartridge 27 and the drum sub-unit 28. It should be noted that a handle 214, which will be described below, is omitted in FIGS. 1 and 2.

As shown in FIG. 2, each of the drum sub-units 28 holds a photosensitive drum 29 as an image carrier, and a scorotron type charger 30, and a cleaning brush 31.

The photosensitive drum 29 which is in a cylindrical shape and extends in a width direction includes a drum body 32 whose uppermost surface layer is a positively-chargeable photoconductive layer formed of polycarbonate, and a drum shaft 33 which is arranged along an axial direction of the drum body 32. The drum body 32 is provided so as to rotate with respect to the drum shaft 33. Both ends of the drum shaft 33 in the axial direction are inserted through the pair of side frames 104 (See FIG. 4) and held by side plates 103 which will be described below (See FIG. 4) so as not to be rotated. At the time of image forming, the photosensitive drum 29 is rotated by driving force from a motor (not shown) which is provided in the body casing 2.

The scorotron type charger 30 is arranged diagonally above and behind the photosensitive drum 29 so as to be opposed to the photosensitive drum 29 leaving a space. The scorotron type charger 30 is held by the center frame 105. This scorotron type charger 30 includes a discharge wire 34 which is opposed to the photosensitive drum 29 leaving a space, and a grid 35 which is provided between the discharge wire 34 and the photosensitive drum 29. At the time of image forming, high voltage is applied to the discharge wire 34, and the discharge wire 34 generates a corona discharge. At the same time, an electric voltage is applied to the grid 35, whereby the surface of the photosensitive drum 29 is uniformly charged to positive polarity, while an amount of electric charge supplied to the photosensitive drum 29 is controlled.

The cleaning brush 31 is held by the center frame 105 and arranged behind the photo sensitive drum 29 so as to be opposed and to come into contact with the photosensitive drum 29. At the time of image forming, cleaning bias is applied to the cleaning brush 31.

(3-2-2) Developing Cartridge

As shown in FIG. 1, the developing cartridges 27 are respectively detachably provided in the drum sub-units 28 corresponding to the respective colors. Specifically, there are the four developing cartridges 27, namely, a black developing cartridge 27K detachably mounted to the black drum sub-unit 28K, a yellow developing cartridge 27Y detachably mounted to the yellow drum sub-unit 28Y, a magenta developing cartridge 27M detachably mounted to the magenta drum sub-unit 28M, and a cyan developing cartridge 27C detachably mounted to the cyan drum sub-unit 28C.

Each developing cartridge includes, as shown in FIG. 2, a developing frame 36; an agitator 37 provided in the developing frame 36 and having an agitating member 48; a supply roller 38; a developing roller 39 as a developing agent carrier; and a layer thickness regulating blade 40 having a blade 53 formed of a metal plate spring member, a pressing portion 54 formed of an insulating silicone rubber and a fixing member 55.

The developing frame 36 is formed into a box shape having an opening 41 at its lower end portion. A partition wall 42 divides the developing frame 36 into a toner containing room 43 and a developing room 44. An communicating hole 45 that communicates the toner containing room 43 with the developing room 44 is formed in the partition wall 42.

In each of the drum sub-units 28 corresponding to the developing cartridges 27, the scorotron type charger 30 generates the corona discharge and uniformly charges the surface of the photosensitive drum 29 to the positive polarity.

The surface of the photosensitive drum 29 is exposed to the laser beam from the scanner part 20 by rapid scanning, after it has been positively charged by the scorotron charger 30, along with the rotation of the photosensitive drum 29, thereby to form an electrostatic latent image corresponding to an image to be formed on the sheet 3.

As the photosensitive drum 29 further rotates, the toner which is carried on a surface of the developing roller 39 and has been positively charged is brought into contact with the photosensitive drum 29 along with rotation of the developing roller 39. The toner is supplied to the electrostatic latent image which has been formed on the surface of the photosensitive drum 29, that is, an exposed area which has been exposed to the laser beam and has a lowered electric potential, out of the surface of the photosensitive drum 29 which has been uniformly and positively charged. In this manner, the electrostatic latent image on the photosensitive drum 29 is developed into a visual image, and a toner image corresponding to each color by reversal development is carried on the surface of the photosensitive drum 29.

The toner which remains on the photosensitive drum 29 after the transfer is recovered by the developing roller 39. Moreover, paper dust from the sheet 3 which adheres to the surface of the photosensitive drum 29 after the transfer is recovered by the cleaning brush 31.

(3-3) Transfer Part

As shown in FIG. 1, the transfer part 22 is arranged above the sheet supply section 4 and below the process part 21 in the body casing 2 along the front-rear direction. This transfer part 22 includes a driving roller 56, a driven roller 57, a conveying belt 58, a transfer roller 59, and a cleaning part 60.

The driving roller 56 and the driven roller 57 are opposed to each other leaving a space in the front-rear direction. The driving roller 56 is arranged more rearward than the cyan drum sub-unit 28C, and the driven roller 57 is arranged more forward than the black drum sub-unit 28K.

The conveying belt 58 is an endless belt formed of a resin film of electrically conductive polycarbonate, polyimide or the like dispersed with electrically conductive particles such as carbon. This conveying belt 58 is wound around the driving roller 56 and the driven roller 57.

At the time of image forming, a driving force from a motor (not shown) which is provided in the body casing 2 is transmitted to the driving roller 56 thereby to rotate the driving roller 56. Then, the conveying belt 58 is cyclically moved between the driving roller 56 and the driven roller 57 so as to move in the opposite direction to the rotation direction of the photosensitive drum 29, at respective transfer positions opposed to and in contact with the photosensitive drums 29 in the drum sub-units 28. At the same time, the driven roller 57 is driven accordingly.

Within the conveying belt 58 which is wound around the driving roller 56 and the driven roller 57, transfer rollers 59 are respectively disposed so as to be opposed to the photosensitive drums 29 interposing the conveying belt 58. Each of the transfer rollers 59 has a roller shaft made of metal which is coated with a rubber roller formed of electrically conductive rubber. At the transfer positions where the transfer rollers 59 are opposed to and brought into contact with the conveying belt 58, the transfer rollers 59 are driven to rotate in the same direction as the cyclical moving direction of the conveying belt 58. At the time of image forming, transfer bias from a high voltage board, which is not shown, provided in the body casing 2 is applied to the transfer rollers 59.

The cleaning part 60 is arranged below the conveying belt 58 which is wound around the driving roller 56 and the driven roller 57. The cleaning part 60 includes a primary cleaning roller 61, a secondary cleaning roller 62, a scraping blade 63, and a toner reservoir 64.

The primary cleaning roller 61 is so arranged as to come into contact with the conveying belt 58 at a lower side, that is, the opposite side to the conveying belt 58 at an upper side which is in contact with the photosensitive drums 29 and the transfer rollers 59. The primary cleaning roller 61 is adapted to be driven to rotate in the same direction as the cyclical moving direction of the conveying belt 58, at the contact positions. At the time of image forming, primary cleaning bias is applied to the primary cleaning roller 61.

The secondary cleaning roller 62 is so arranged as to come into contact with the primary cleaning roller 61 from below, and adapted to rotate in the opposite direction to the direction of rotation of the primary cleaning roller 61, at the contact position. At the time of image forming, secondary cleaning bias is applied to the secondary cleaning roller 62.

The scraping blade 63 is so arranged as to come into contact with the secondary cleaning roller 62 from below.

The toner reservoir 64 is provided below the primary roller 61 and the secondary roller 62 so that the toner falling down from the secondary cleaning roller 62 can be stored therein.

The sheet 3 which has been supplied from the sheet supply section 4 is conveyed from the front side toward the rear side by the conveying belt 58 which is cyclically moved by the driving roller 56 and the driven roller 57 so as to successively pass the transfer positions corresponding to the respective drum sub-units 28. During the conveyance, the toner images of the respective colors which are carried on the photosensitive drums 29 in the drum sub-units 28 are sequentially transferred to the sheet 3, whereby a color image is formed on the sheet 3.

Specifically, after a black toner image carried on the surface of the photosensitive drum 29 of the black drum sub-unit 28K has been transferred to the sheet 3, a yellow toner image carried on the surface of the photosensitive drum 29 of the yellow drum sub-unit 28Y is transferred in a superposing manner to the sheet 3 to which the black toner image has been already transferred. In succession, with the same operation, a magenta toner image carried on the surface of the photosensitive drum 29 of the magenta drum sub-unit 28M and a cyan toner image carried on the surface of the photosensitive drum 29 of the cyan drum sub-unit 28C are transferred to the sheet 3 in a superposing manner, whereby the color image is formed on the sheet 3.

On the other hand, the toner adhered to the surface of the conveying belt 58 during the transfer operation is transferred from the surface of the conveying belt 58 to the primary cleaning roller 61 by the primary cleaning bias, and then, to the secondary cleaning roller 62 by the secondary cleaning bias. Thereafter, the toner which has been transferred to the secondary cleaning roller 62 is scraped off by the scraping blade 63, and falls from the secondary cleaning roller 62 to be stored in the toner reservoir 64.

(3-4) Fixing Part

The fixing part 23 is provided more rearward than the cyan drum sub-unit 28C in the body casing 2 and arranged so as to be opposed in the front-rear direction to the transfer position where the photosensitive drum 29 is contacted with the conveying belt 58. This fixing part 23 includes a heating roller 65 and a pressurizing roller 66.

The heating roller 65 is a metal tube having a releasing layer formed on its surface. The heating roller 65 has a halogen lamp which is incorporated therein along an axial direction thereof. The heating roller 65 is heated by the halogen lamp so that the surface of the roller is heated to a fixing temperature.

The pressurizing roller 66 is disposed below the heating roller 65 so as to be opposed to the heating roller 65. This pressurizing roller 66 presses the heating roller 65 from below.

The color image which has been transferred to the sheet 3 is conveyed to the fixing part 23, and fixed by heating on the sheet 3, while the sheet 3 passes between the heating roller 65 and the pressurizing roller 66. In this manner, formation of the image on the sheet 3 is achieved.

(4) Sheet Discharge Section

In the sheet discharge section 6, a conveying path 67 at a discharging side of the sheet 3 is provided in such a manner that its upstream end is adjacent to the fixing part 23 in a lower region, and its downstream end is adjacent to a sheet discharge tray 68 in an upper region. The conveying path 67 is formed in a substantially U-shape in a side view so that the sheet 3 is supplied rearward and thereafter discharged to the front side after the sheet 3 has been reversed.

In the middle of the conveying path 67 at the sheet discharge side, a conveying roller 69 and a pinch roller 70 are provided so as to be opposed to each other. Moreover, a pair of sheet discharge rollers 71 are provided at the downstream end of the conveying path 67 at the sheet discharge side.

The sheet discharge section 6 is further provided with the sheet discharge tray 68. The sheet discharge tray 68 is formed by gradually denting an upper wall of the body casing 2 from the front side toward the rear side so that sheets 3 which have been discharged can be placed thereon in a stacked manner.

The sheet conveyed from the fixing part 23 is conveyed along the conveying path 67 at the sheet discharge side by means of the conveying roller 69 and the pinch roller 70, and then discharged onto the sheet discharge tray 68 by the sheet discharge roller 71.

2. Drum Unit

Figure 3:
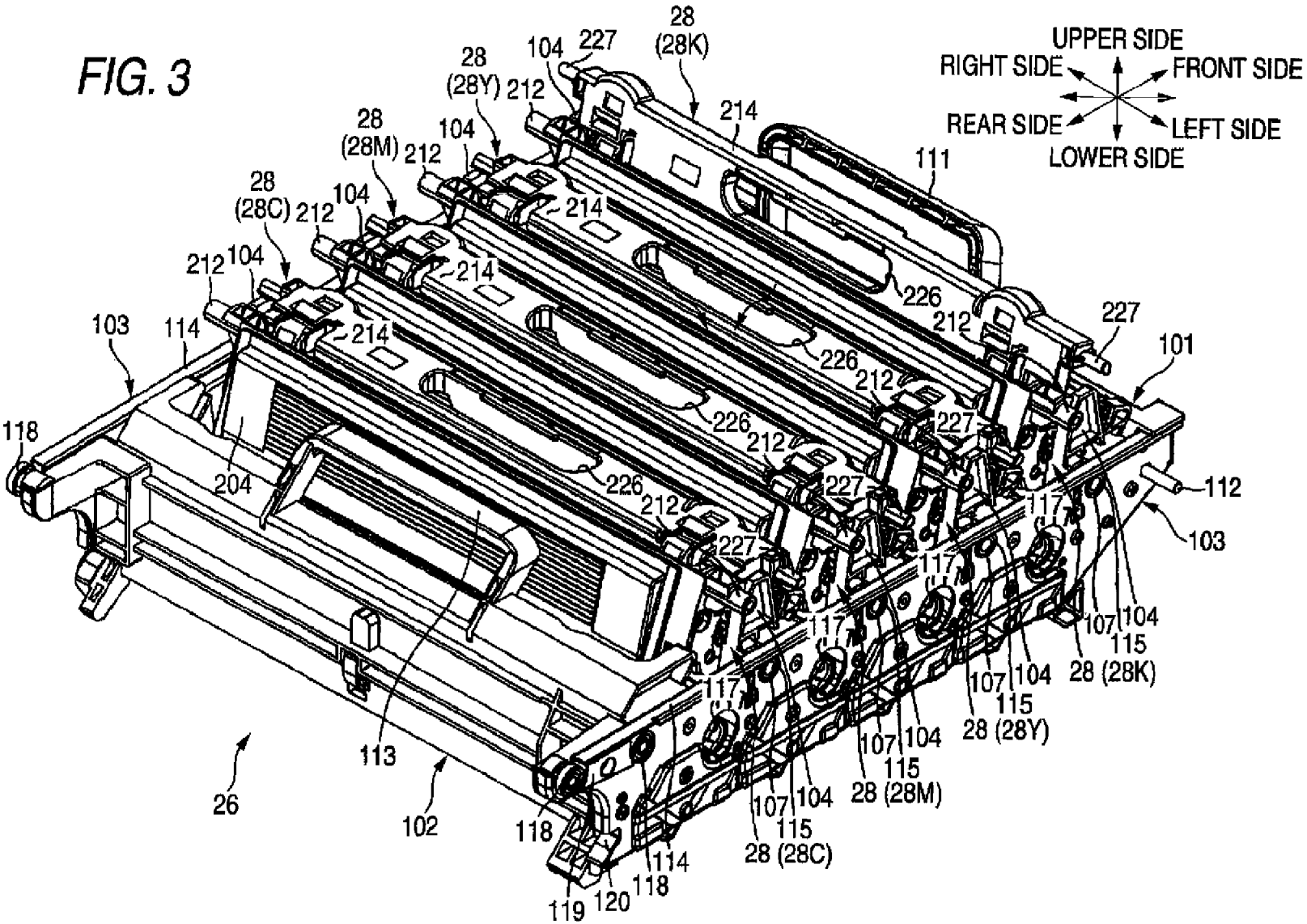
FIG. 3 is a perspective view of a drum unit (in a state where four developing cartridges are mounted thereto) shown in FIG. 1, as seen from above at a left rear side.

FIG. 3 is a perspective view of the drum unit 26 (in a state where the four developing cartridges 27 are mounted thereto) as seen from above at a left rear side. FIG. 4 is a perspective view of the drum unit 26 (in a state where one of the developing cartridges 27 is being mounted or detached, while the other developing cartridges 27 have been detached) as seen from above at a left front side. FIG. 5 is a left side view of the drum unit 26.

The drum unit 26 contains the four drum sub-units 28 corresponding to the four colors. The drum unit 6 includes a front beam 101 and a rear beam 102 which are provided at both sides in the front-rear direction of the four drum sub-units 28 which are arranged in parallel along the front-rear direction, and a pair of side plates 103 which enclose the front beam 101, the four drum sub-units 28, and the rear beam 102 from both sides in the width direction (in the direction from left to right).

The drum unit 26 together with the four drum sub-units 28, the front beam 101, the rear beam 102, and the pair of side plates 103 which are integrally assembled are slidably mounted to and detached from the drum containing space 7 (See FIG. 1) in the body casing 2.

(1) Drum Sub-unit

Figure 4:
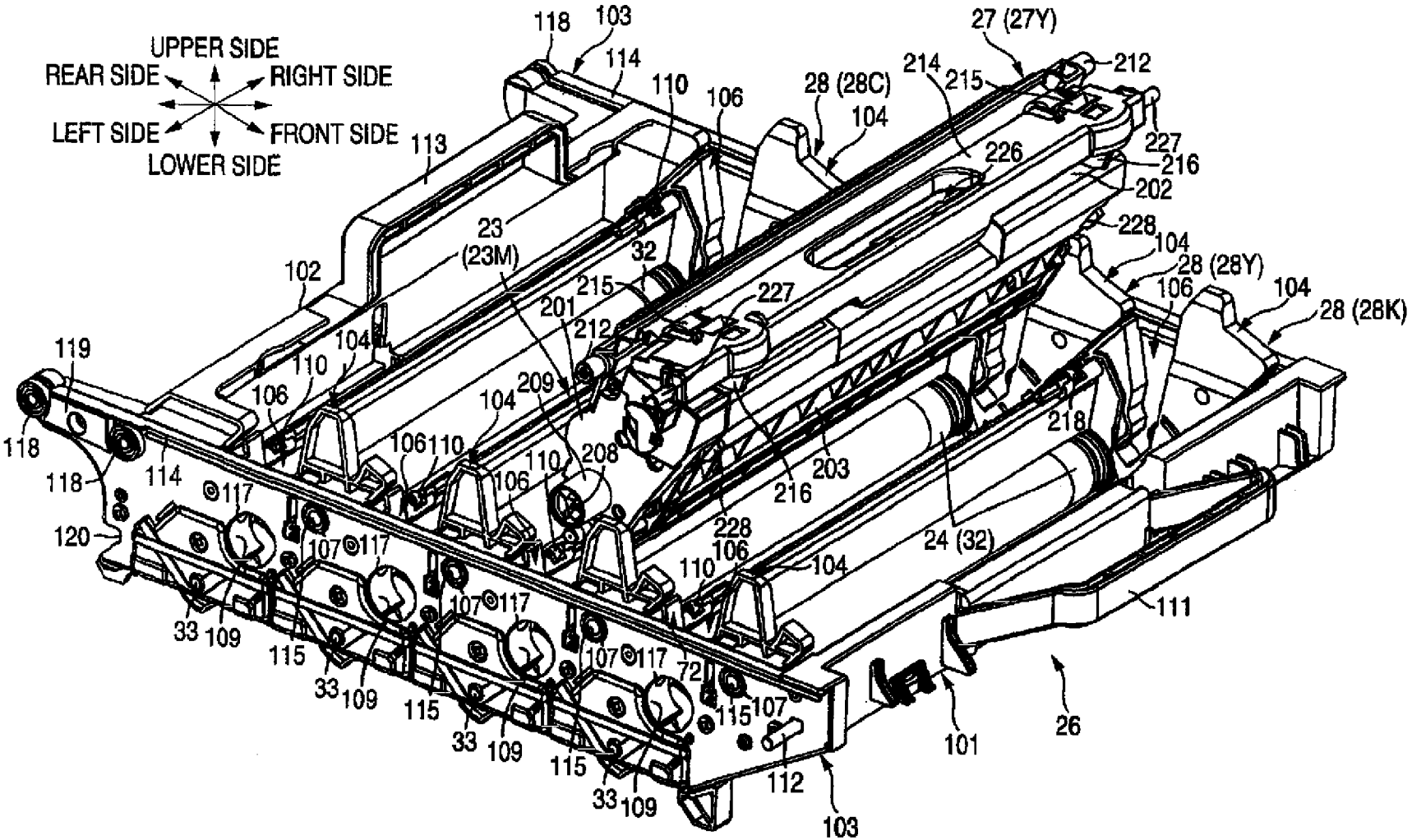
FIG. 4 is a perspective view of the drum unit (in a state where one of the developing cartridges is being mounted or detached, while the other developing cartridges are detached) shown in FIG. 1, as seen from above at a left front side.
Figure 5:
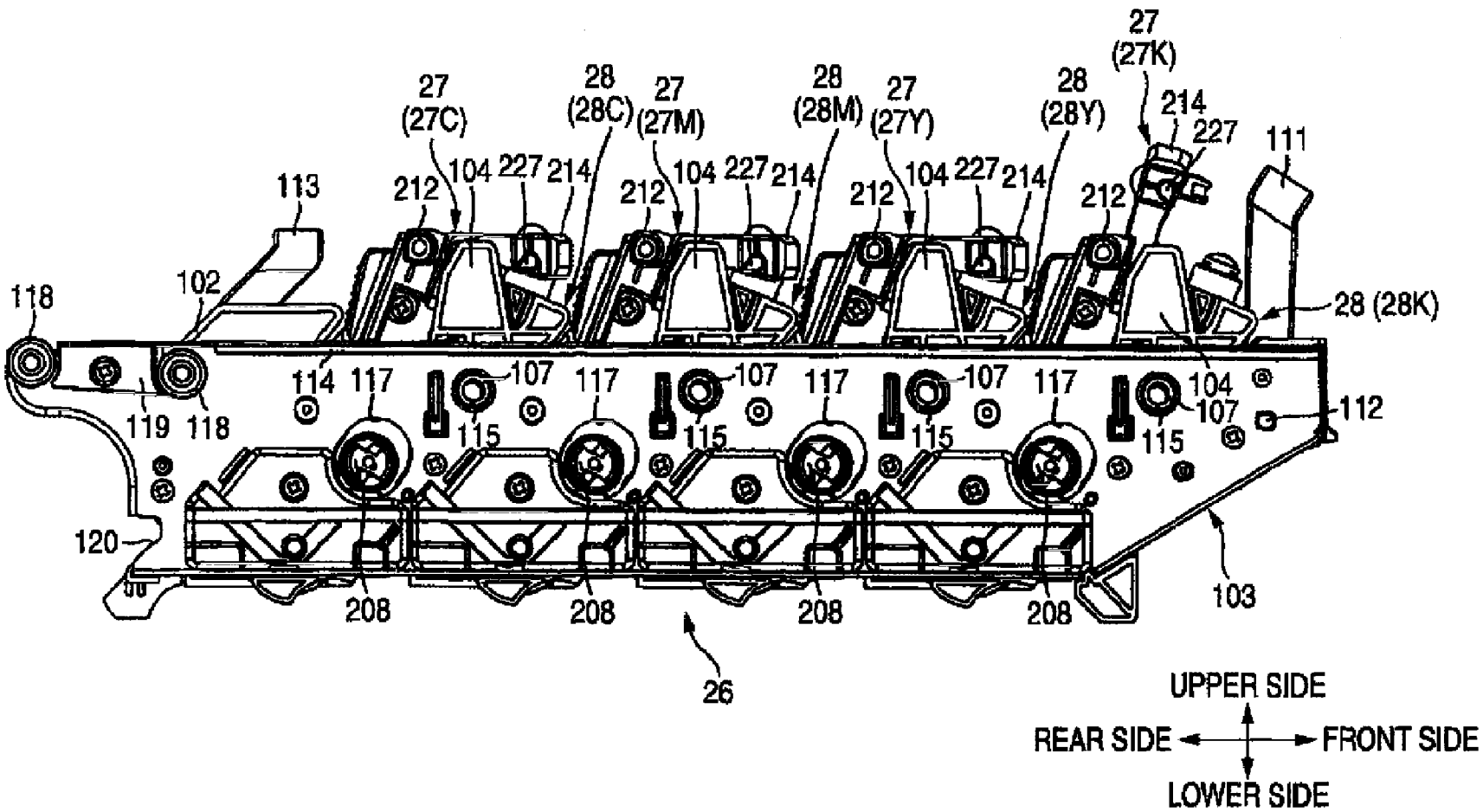
FIG. 5 is a right side view of the drum unit shown in FIG. 1.

As shown in FIG. 4, the drum sub-unit 28 has the pair of side frames 104 which are opposed to each other at a distance in the width direction and the center frame 5 (See FIG. 2) which is bridged between the two side frames 104 along the width direction.

Each of the side frames 104 is formed of resin material into a shape of a flat plate. The drum shaft 33 of the photosensitive drum 29 is inserted into the two side frames 104.

The side frame 104 is provided with a guide groove 106 for guiding mounting and detaching movement of the developing cartridge 27 with respect to the drum sub-unit 28. The guide groove 106 is formed along a substantially vertical direction from an upper end edge at the rear side of the side frame 104 to a position near a lower end at the front side of the side frame 104. The lowermost end part (the deepest part) of the guide groove 106 is so arranged as to correspond to the position of a developing roller shaft 51 in a state where the developing roller 39 is in contact with the photosensitive drum 29. The guide groove 106 slidably receives a collar member 205 which will be described below.

Moreover, a boss 107 is formed in each of the side frames 104. This boss 107 is formed in a cylindrical shape and projected outward in the width direction from the side frame 104. This boss 107 is arranged so as to be opposed in the width direction to a window 206 in the developing cartridge 27, which will be described below, in a state where the developing cartridge 27 has been mounted to the drum sub-unit 28.

Further, the side frame 104 at the left side is provided with a coupling inside insertion hole 109 which is opposed in the width direction to a coupling receiving gear 208 of the developing cartridge 27 which will be described below. This coupling inside insertion hole 109 is formed as a round hole passing through the side frame 104 at the left side, in the direction of its thickness.

The center frame 105 is formed of resin material. Support rollers 110 for supporting the developing cartridge 27 are provided on both ends in the width direction of an upper end part of the center frame 105. The support rollers 110 are rotatably held by a rotation shaft (not shown) which extends in the width direction along the upper end part of the center frame 105.

(2) Front Beam

The front beam 101 is integrally formed of resin material. The front beam 101 is disposed in front of the four sub-units 28 which are arranged in parallel along the front-rear direction so as to be bridged between the pair of side plates 103.

The front beam 101 has a front side gripping part 111 attached to its center part in the width direction, and a support shaft 112 for rotatably supporting the front side gripping part 111.

The front side gripping part 111 has a substantially U-shape, and both ends thereof are rotatably supported by the support shaft 112 at the center part in the width direction in such a manner that the front side gripping part 111 can be tilted between a stored position where the front side gripping part 111 is erected along the front beam 101 (See FIG. 3) and an operative position where it is inclined frontward from the front beam 101 (See FIG. 4).

The support shaft 112 is supported by the front beam 101 so as to pass through the front beam 101 in the width direction. Opposite ends in the width direction of the support shaft 112 project outward from the front beam 101, and further, pass through the side plates 103 to project outward in the width direction.

(3) Rear Beam

The rear beam 102 is integrally formed of resin material. The rear beam 102 is disposed in rear of the four sub-units 28 which are arranged in parallel along the front-rear direction, so as to be bridged between the pair of side plates 103.

As shown in FIG. 3, this rear beam 102 is formed in a substantially C-shape which is open rearward in a plan view. A rear side gripping part 113 is integrally provided in a center part in the width direction of the rear beam 102. The rear side gripping part 113 has a substantially U-shape in a rear view, and both ends thereof are connected to the rear beam 102 and inclined from a lower part at the rear side upwardly toward the front side so as to project diagonally upwardly from the rear beam 102.

(4) Side Plates

The side plates 103 are formed of material which is more rigid than the resin material for forming the front beam 101 and the rear beam 102, such as metal or fiber reinforced resin. Preferably, the side plates 103 are formed of steel plate.

Each of the side plates 103 has a shape of a rectangular plate elongated in the front-rear direction in a side view. The side plates 103 are provided in such an arrangement, with respect to the front beam 101, the four drum sub-units 28, and the rear beam 102 which are arranged in parallel in the front-rear direction, that their front ends are opposed to the front beam 101 while their rear ends are opposed to the rear beam 102. The side plates 103 are fixed to both the front and rear beams.

Respective upper ends of the side plates 103 are bent outward in the width direction in an L-shape in cross section thereby to form flange portions 114 projecting outward in the width direction. These flange portions 114 extend on rectilinear lines along the front-rear direction (in a horizontal direction).

Each of the side plates 103 is formed in a substantially L-shape extending rearward in a side view, at an upper end of its rearward end part. Two roll members 118 are rotatably provided in this rearward extending portion. These two roll members 118 are disposed interposing a spacer 119 in the front-rear direction. The roll member 118 at a front side is arranged below the flange portion 114, and the roll member 118 at a rear side is arranged behind a rear end of the flange portion 114.

The side plate 103 is further provided, in its rearward end area, with a cut-away portion 120 which is cut away from the rearward end in a U-shape in a side view. In a state where the drum unit 26 has been mounted in the body casing 2, a positioning shaft (not shown) which is arranged in the body casing 2 is engaged with this cut-away portion 120, whereby the drum unit 26 is positioned with respect to the body casing 2.

Still further, the side plate 103 is provided, in its upper end area, with four light penetrating holes 115 for respectively receiving the bosses 107 of the drum sub-units 28. The light penetrating holes 115 are formed at intervals in the front-rear, in the upper end area of the side plate 103. These light penetrating holes 115 are round holes passing through the side plate 103 in a direction of its thickness at respective positions opposed to the bosses 107 of the drum sub-units 28. The bosses 107 of the drum sub-units 28 are engaged with the light penetrating holes 115 so as to be exposed outward in the width direction, and thus, the rotations of the drum sub-units 28 around the drum shafts 33 with respect to the side plates 103 are restrained.

Still further, the side plate 103 is provided, at its lower end area, with shaft holes 116 through which axially end portions of the drum shafts 33 are passed through. The side plate 103 at the left side is provided with four coupling outside insertion holes 117 to which the coupling receiving gears 208 of the developing cartridges 27 are opposed in the width direction. These coupling outside insertion holes 117 are formed in the middle in the vertical direction of the side plate 103 at intervals in the front-rear direction. These coupling outside insertion holes 117 are formed as round holes passing through the side plate 103 in the direction of its thickness, at positions opposed to the coupling inside insertion holes 109 of the drum sub-units 28.

3. Developing Cartridge

Figure 6:
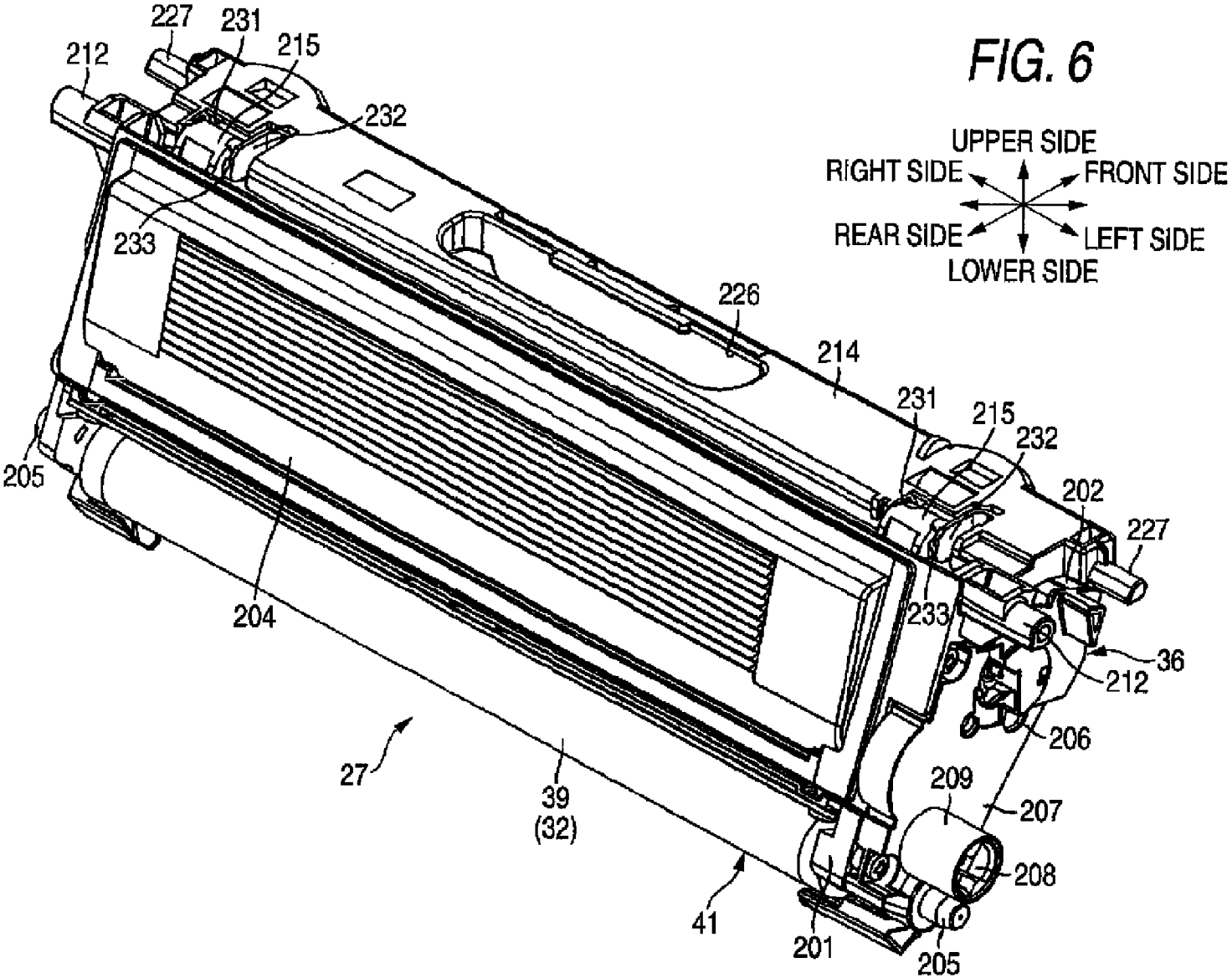
FIG. 6 is a perspective view of the developing cartridge shown in FIG. 1, as seen from a left rear side, showing a tilted state of a handle.
Figure 7:
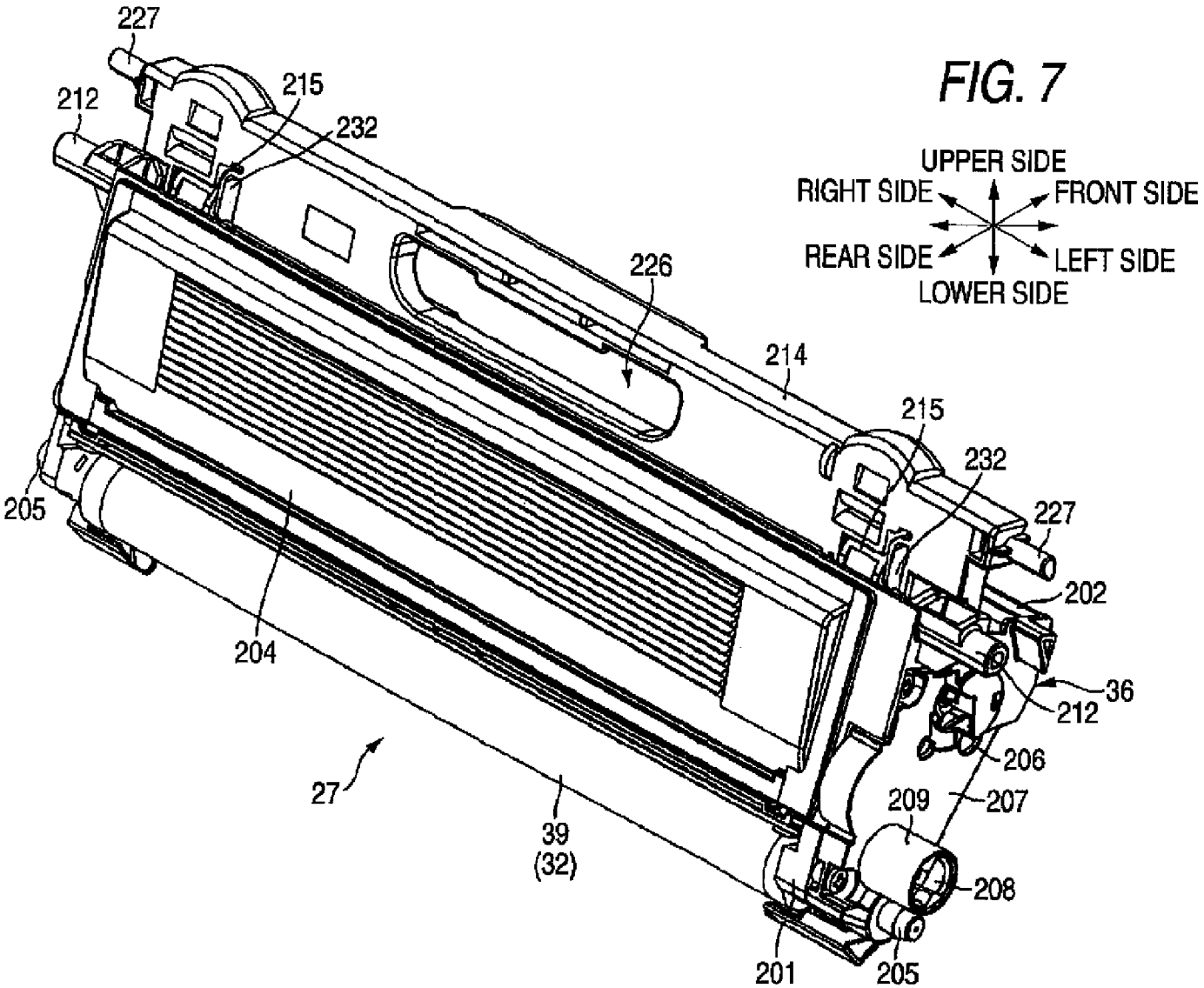
FIG. 7 is a perspective view of the developing cartridge shown in FIG. 1, as seen from a left rear side, showing an erected state of the handle.
Figure 8:
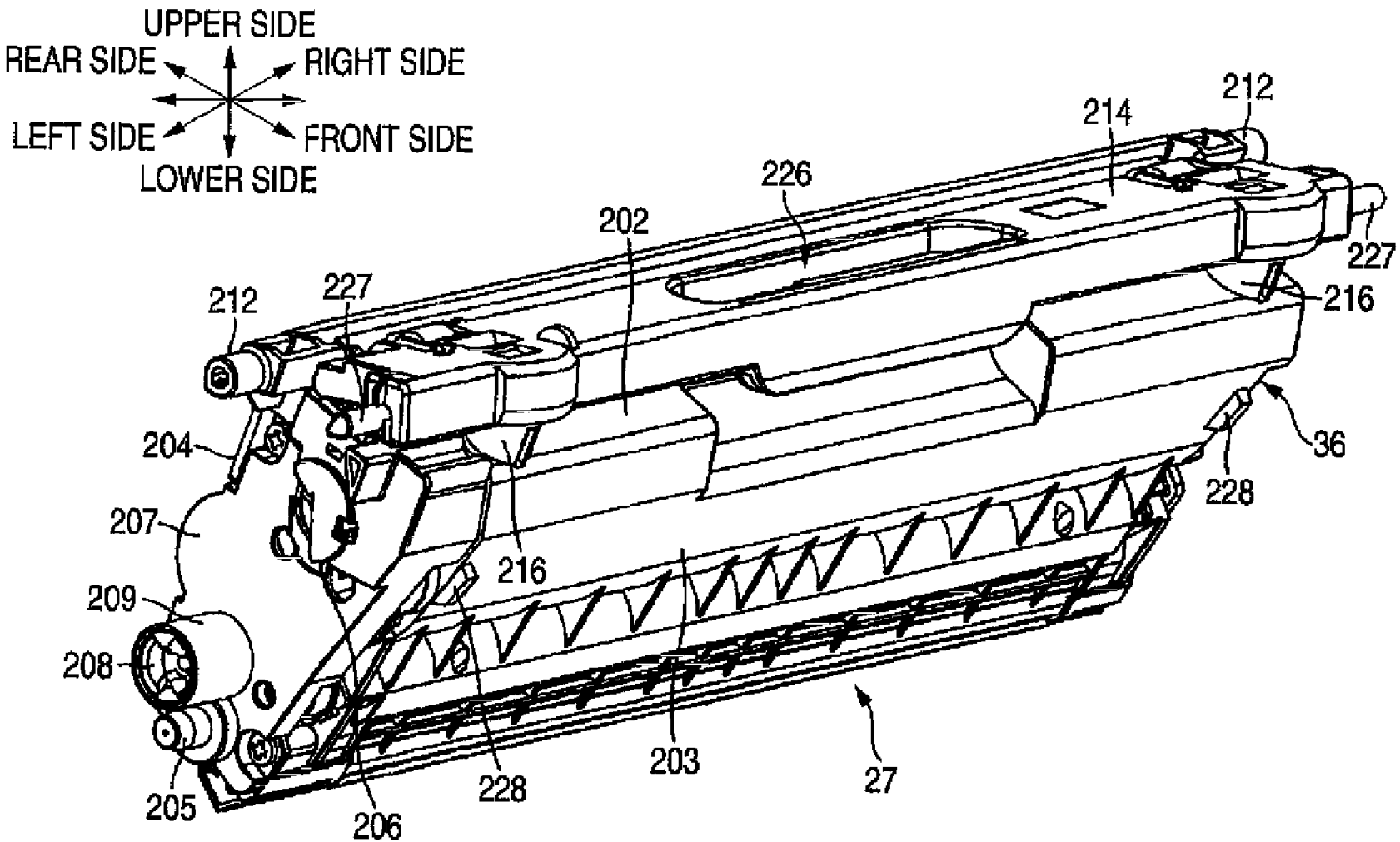
FIG. 8 is a perspective view of the developing cartridge shown in FIG. 1, as seen from a left front side, showing the tilted state of the handle.
Figure 9:
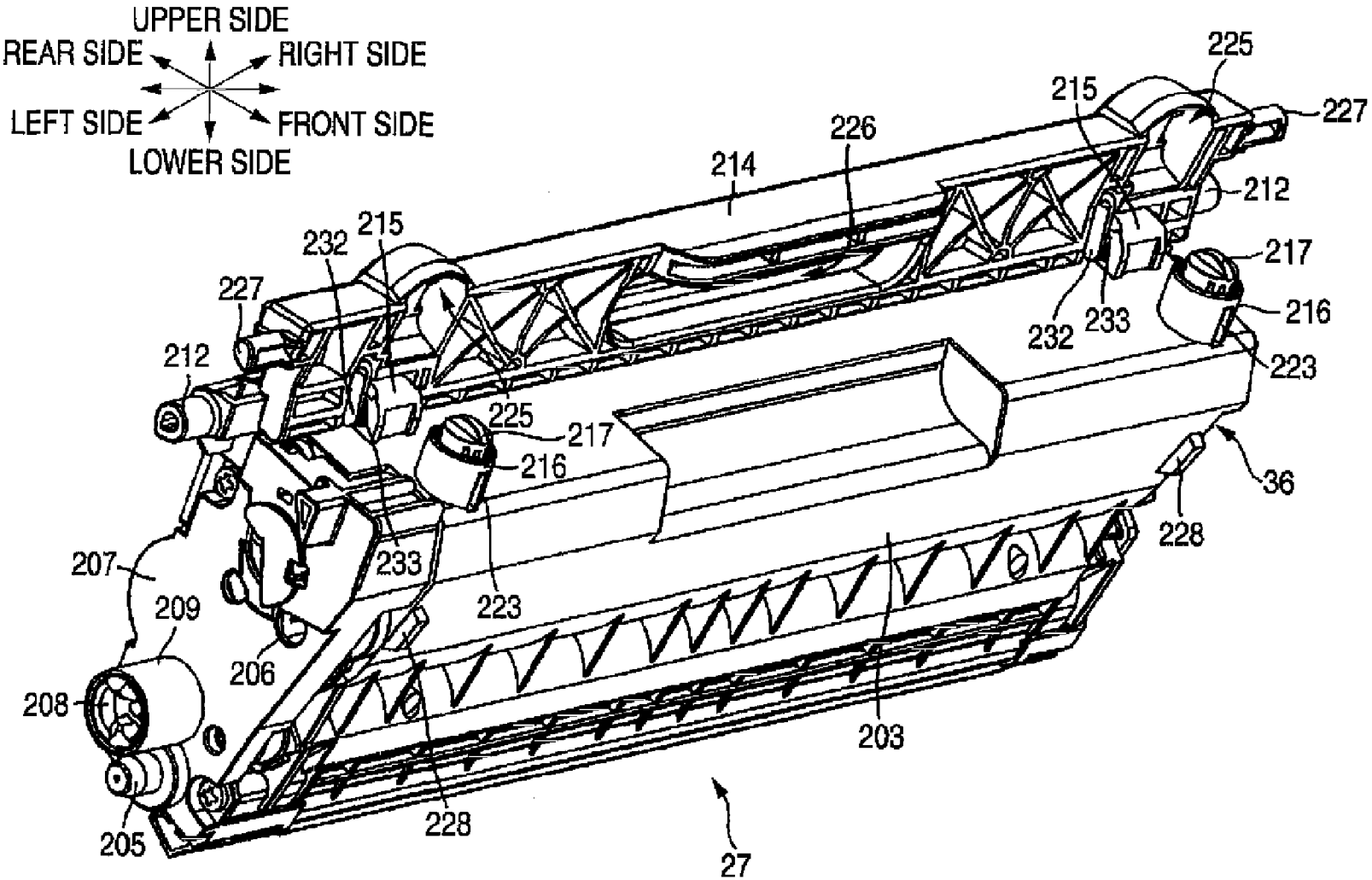
FIG. 9 is a perspective view of the developing cartridge shown in FIG. 1, as seen from a left front side, showing the erected state of the handle.
Figure 10:
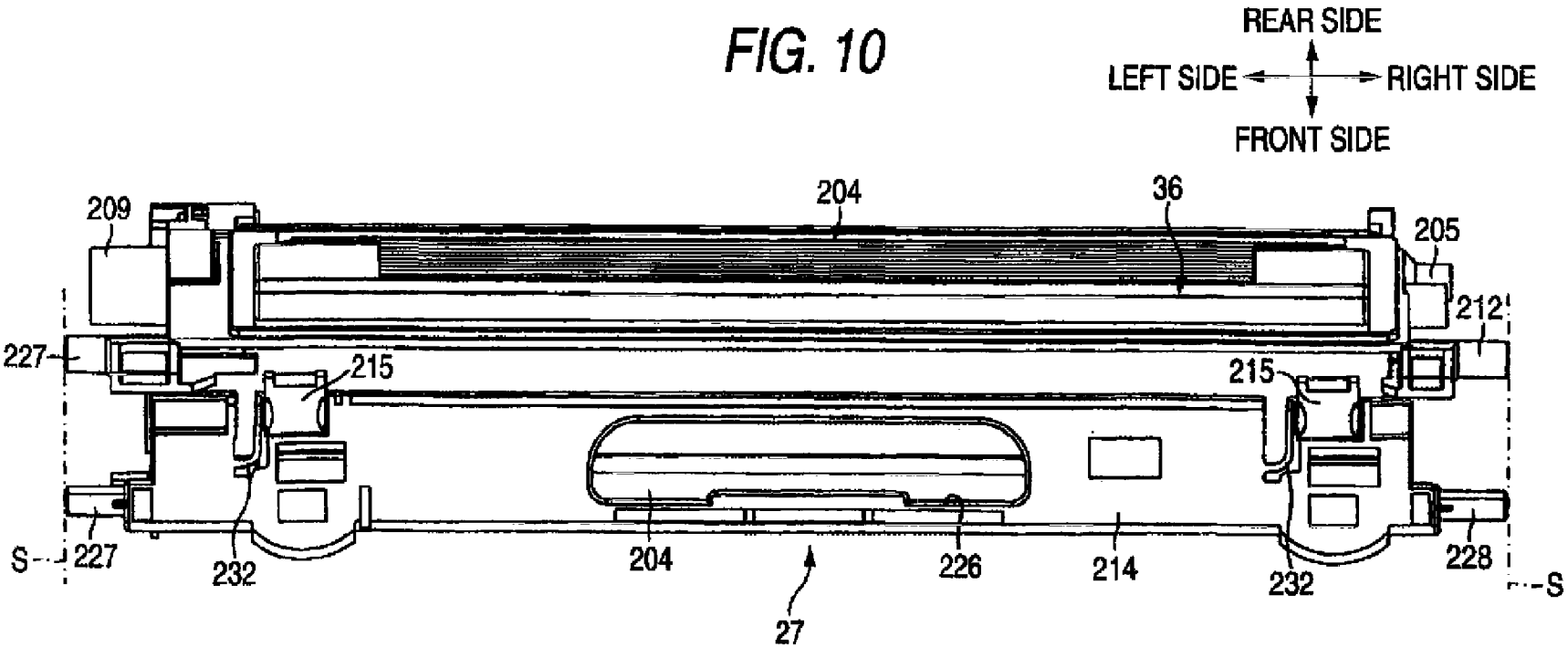
FIG. 10 is a plan view of the developing cartridge shown in FIG. 1.
Figure 11:
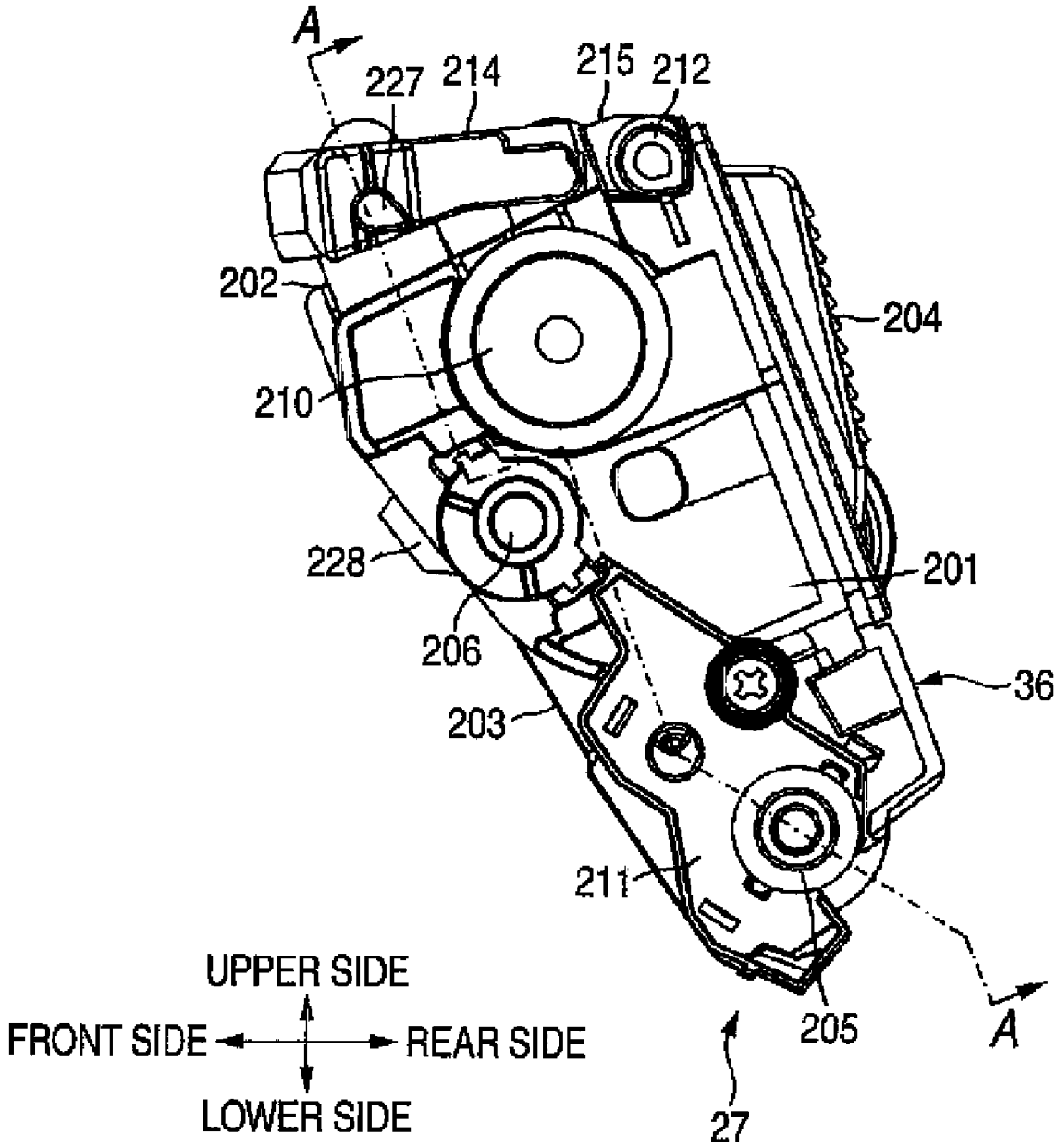
FIG. 11 is a right side view of the developing cartridge shown in FIG. 1.
Figure 12:
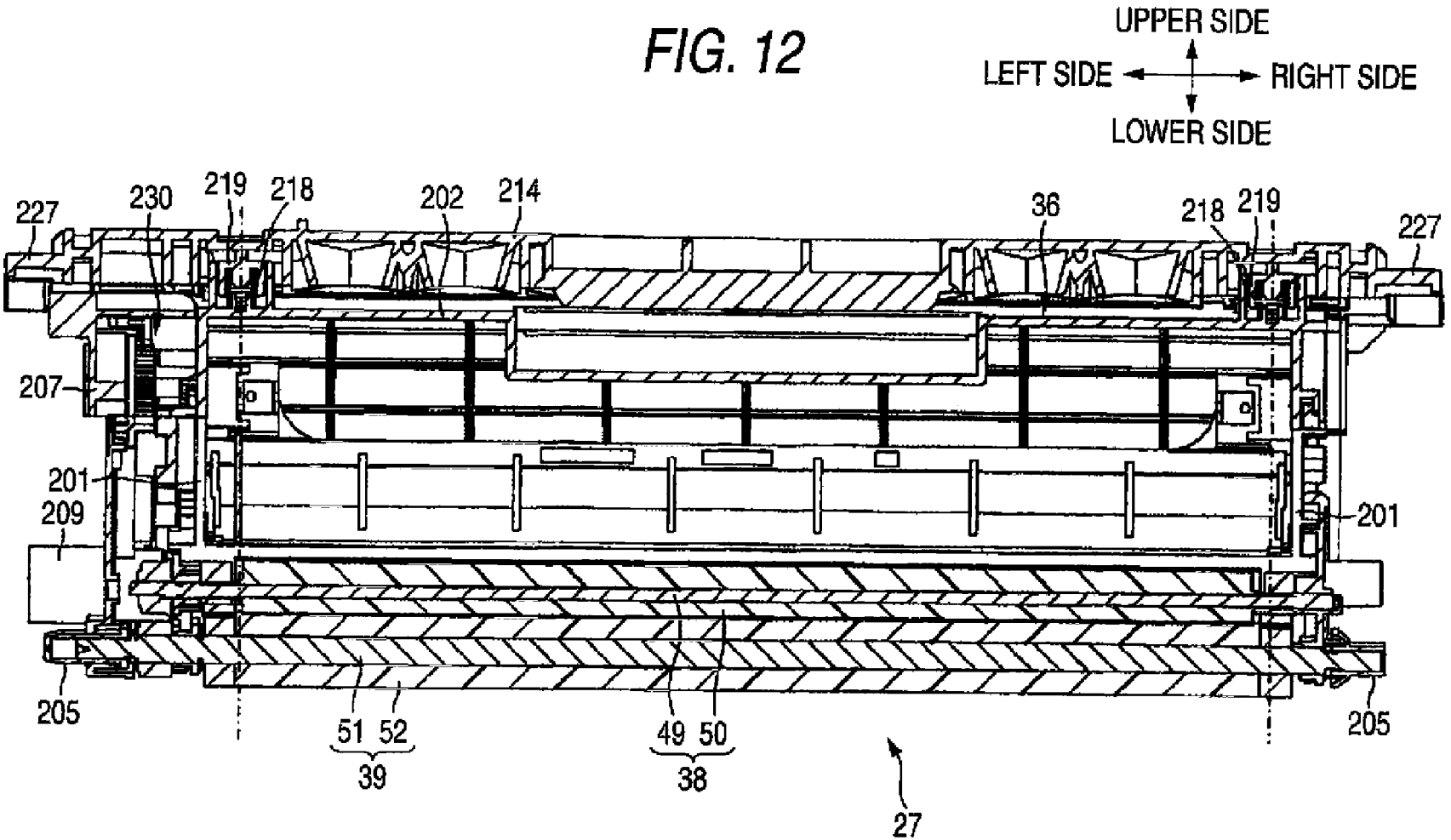
FIG. 12 is a sectional view taken along a line A-A in FIG. 11.
Figure 13:
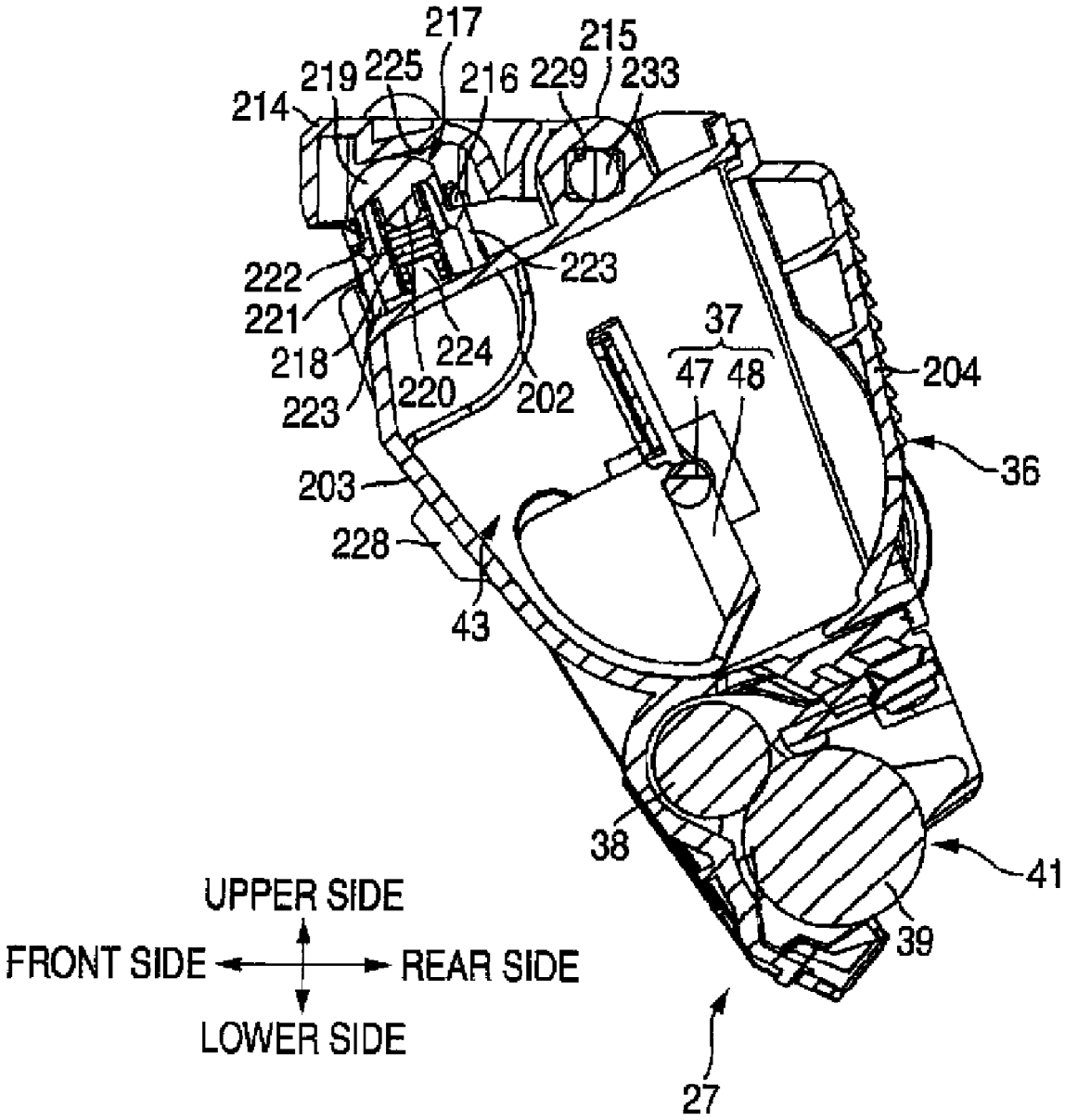
FIG. 13 is a right side sectional view of the developing cartridge shown in FIG. 1, showing the tilted state of the handle.
Figure 14:
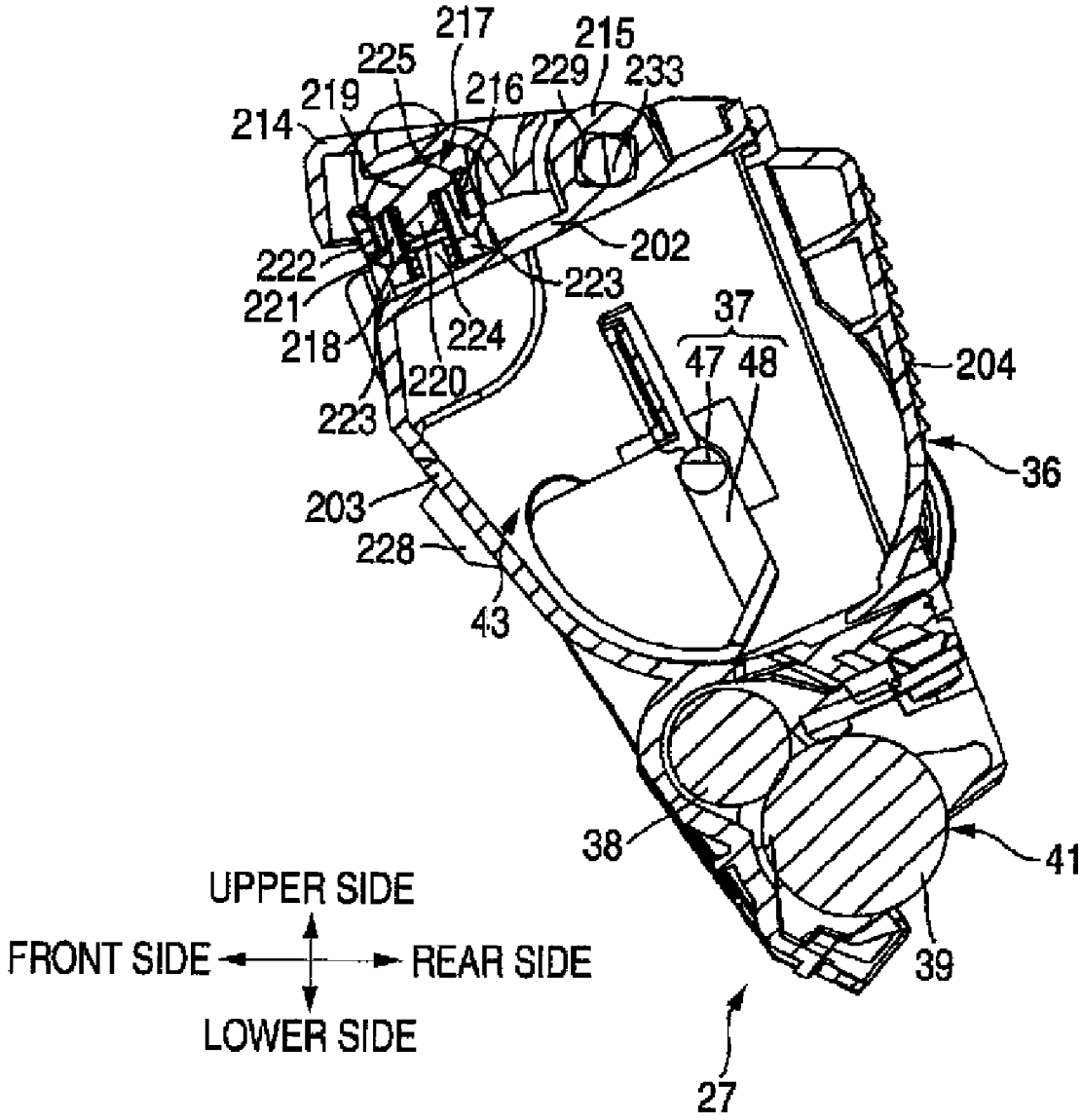
FIG. 14 is a right side sectional view of the developing cartridge shown in FIG. 1, showing the pressurized state of the handle.

FIGS. 6 and 7 are perspective views of the developing cartridge 27 as seen from a left rear side, and FIGS. 8 and 9 are perspective views of the developing cartridge 27 as seen from a left front side. FIG. 10 is a plan view of the developing cartridge 27, FIG. 11 is a right side view of the developing cartridge 27, and FIG. 12 is a sectional view taken along a line A-A in FIG. 11. FIGS. 13 and 14 are right side sectional views of the developing cartridge 27. It should be noted that the supply roller 38 and the developing roller 39 are shown in a simplified form in FIGS. 13 and 14.

(1) Developing Cartridge

The developing frame 36 of the developing cartridge 27 is integrally provided with a pair of side walls 201 which are opposed to each other in the width direction, an upper wall 202 which is bridged between upper end edges of the two side walls 201, a front wall 203 which is bridged between front end edges of the two side walls 201, and a rear wall 204 which is bridged between rear end edges of the two side walls 201. The opening 41 is defined by lower end edges of the two side walls 201, the front wall 203 and the rear wall 204 so that the developing roller 39 is exposed.

Windows 206 for detecting remaining amount of the toner which is contained in the toner containing room 43 are embedded in the two side walls 201. These windows 206 are arranged so as to be opposed to each other interposing the toner containing room 43 so that a light for detecting the remaining amount of the toner can pass them through in the width direction.

The side wall 201 at the left side is provided with a gear mechanism which is covered with a gear cover 207, as shown in FIGS. 6 to 9. This gear mechanism includes the coupling receiving gear 208 which is exposed from the gear cover 207, and a gear train 230 (See FIG. 12) which is meshed with the coupling receiving gear 208 inside the gear cover 207.

Gear disposing part 209 in a cylindrical shape is formed at a lower end area of the gear cover 207 so as to project outward in the width direction. The coupling receiving gear 208 is disposed in the gear disposing part 209 and exposed from a distal end face of the gear disposing part 209.

A coupling shaft (not shown) provided in the body casing 2 is coupled to the coupling receiving gear 208 so as to move forward and rearward, and so as not to be relatively rotated. A driving power of a motor (not shown) provided in the body casing 2 is inputted from this coupling shaft.

The gear train 230 includes an agitator driving gear fixed to a rotation shaft 47 of the agitator 37, a supply roller driving gear fixed to a supply roller shaft 49 of the supply roller 38, a developing roller driving gear fixed to the developing roller shaft 51 of the developing roller 39, and so on, which are meshed with the coupling receiving gear 208 by way of intermediate gears. Therefore, the driving power inputted to the coupling receiving gear 208 is transmitted to the agitator 37, the supply roller 38 and the developing roller 39 by way of the gear train 230.

As shown in FIG. 11, a cap 210 which closes a toner filling port (not shown) for filling the toner into the toner containing room 43 is provided on the side wall 201 at the right side, at a position above the window 206. Moreover, a bearing member 211 which rotatably supports a right end portion of the developing roller shaft 51 is provided in a lower end area of the side wall 201 at the right side. As shown in FIG. 12, the right end portion of the developing roller shaft 51 is rotatably inserted into the bearing member 211, and the left end portion of the developing roller shaft 51 is rotatably inserted into the sidewall 201 at the left side, where by the developing roller shaft 51 is rotatably supported by the developing frame 36. Both the right end portion and the left end portion of the developing roller shaft 51 are respectively projected from the bearing members 211 and the gear covers 207 outward in the width direction, and the projected portions are respectively covered with collar members 205.

As shown in FIGS. 6 to 9, separating projections 212 in a substantially cylindrical shape are provided in the upper end parts of the two side walls 201 so as to project outward in the width direction from the parts connected to an upper end part of the rear wall 204.

The upper wall 202 is provided with a handle 214 to be gripped when the developing cartridge is carried, which also serves as a pressure member. This handle 214 is formed in a shape of thin plate which is elongated in the width direction, and provided so as to be swung into an erected state in which it has been erected at a substantially right angle with respect to the upper wall 202 (See FIGS. 7 and 9), a tilted state in which it has been tilted frontward than in the erected state to come close to the upper wall 202 (See FIGS. 6, 8 and 13), and a pressurized state in which it has come closer to the upper wall 202 than in the tilted state (See FIG. 14).

More specifically, as shown in FIGS. 13 and 14, handle support portions 215 in a substantially semicircular shape in a side view which are projected upward are integrally formed in a rearward end part of the upper wall 202, at both ends in the width direction thereof. The handle support portions 215 are respectively formed with through holes 229 which pass them through in the width direction. On the other hand, as shown in FIGS. 6 and 7, the handle 214 is formed with cut-outs 231 at both ends in the width direction in the rearward end part thereof, with which the handle support portions 215 can be engaged. In each of the cut-outs 231, an elastically deformable portion 232 in a substantially L-shape in a plan view is provided having its base end connected to a left side face of the cut-out 231. An end of the elastically deformable portion 232 is opposed to and spaced from a right side face of the cut-out 231 in the width direction, and the handle support portion 215 is fitted between the end of the elastically deformable portion 232 and the right side face of the cut-out 231. The end of the elastically deformable portion 232 and the right side face of the cut-out 231 are respectively provided with support shafts 233 so as to project in a direction of coming close to each other. In a state where the support shafts 233 are spaced apart by deforming the elastically deformable portion 232, the handle support portion 215 is fitted into the cut-out 231, and thereafter, by releasing the elastically deformable portion 232 from the deformed state, the support shafts 33 are allowed to be inserted into the through hole 229 of the handle support portion 215. In this manner, the handle 214 can be fitted to the handle support portion 215 so as to be oscillated.

As shown in FIGS. 9 and 12, a pair of spring guide members 216 in a cylindrical shape are formed in a forward end part of the upper wall 202 at both ends thereof in the width direction (an axial direction of the developing roller 39) at an interval substantially equal to a length in the width direction (a length in the axial direction) of a sponge roller 50 of the developing roller 39. The spring guide members 216 are respectively opposed to the handle support portions 215 spaced in the front-rear, and at the same time, respectively opposed to both ends of a rubber roller 52 of the developing roller 39 in the width direction. Each of the spring guide members 216 contains therein a contact member 217 which can move up and down, and a coil spring 218 which always urges the contact member 217 upward, as shown in FIGS. 13 and 14.

The contact member 217 integrally has a body portion 219 in a substantially round shape in a plan view whose upper face is convex-curved, a boss 220 projecting downward from a center of a lower face of the body portion 219, and an extended portion 221 in a cylindrical shape which extends from a circumference of the lower face of the body portion 219 along an inner face of the spring guide member 216. The extended portion 221 is provided with a plurality of locking hooks 222. The locking hooks 222 are fitted into grooves 223 which are formed in the spring guide member 216, and distal ends of the locking hooks 222 are locked to upper ends of the grooves 223, so that the contact member 217 is not be detached from the spring guide member 216.

The coil spring 218 is provided in a compressed state between the contact member 217 and the upper wall 202, by inserting a spring fitting boss 224 formed in the upper wall 202 into a lower end of the coil spring 218, and by inserting the boss 220 of the contact member 217 into an upper end of the coil spring 218.

As shown in FIG. 9, recesses 225 capable of receiving the corresponding contact members 217 are formed on a lower face of the handle 214 (the face opposed to the upper wall 202) at respective positions corresponding to the contact members 217. In a state where the handle 214 is tilted into the tilted state, the contact members 217 are respectively received in the recesses 225, and top ends of the contact members 217 are butted against bottom faces of the recesses 225 (the lower face of the handle 214).

Moreover, as shown in FIG. 10, the handle 214 is formed with a gripping hole 226 in a substantially rectangular shape in a plan view which is elongated in the width direction in a center part of the handle 214. Therefore, it is possible to grip the handle 214 by inserting fingers in the gripping hole 226.

The handle 214 is further provided with pressing projections 227 in a substantially columnar shape in a side view projecting outward in the width direction, at both ends in the width direction in a front end area thereof. As shown in FIG. 10, the pressing projections 227 are formed having such a length that their distal end faces are positioned on a same plane S which includes distal end faces of the separating projections 212 projecting to the same sides. In other words, the distal end faces of the pressing projections 227 are arranged at the same position in the width direction as the distal end faces of the separating projections 212 which project to the same sides. Moreover, in a state where the developing cartridges 27 have been mounted to the drum sub-units 28 and the handle 214 has been tilted into the tilted state, the pressing projections 227 are positioned lower than the separating projections 212, as shown in FIG. 11.

As shown in FIGS. 8 and 9, the front wall 203 is provided with projections to be supported 228 in a substantially trapezoidal shape in a side view which protrude frontward, at both ends thereof in the width direction.

(2) Mounting and Dismounting of the Developing Cartridge to and from the Drum Unit The handle 214 is gripped by inserting fingers in the gripping hole 226 of the handle 214, whereby the developing cartridge 27 corresponding to the particular color is mounted to the drum sub-unit 28 corresponding to the developing cartridge 27 from above, as shown in FIG. 4.

More specifically, the collar members 205 at both sides in the axial direction of the developing roller shaft 51 in each of the developing cartridges 27 are inserted into the guide grooves 106 in the side frames 104 of the corresponding drum sub-unit 28, and then, the developing cartridge 27 is pushed downward along the guide grooves 106 into the drum sub-unit 28. When the developing roller 39 has come into contact with the photosensitive drum 29, further push of the developing cartridge 27 is restrained. Then, the developing cartridge 27 is tilted around the developing roller shaft 51 under its own weight in such a manner that the upper end part of the developing cartridge 27 is inclined toward the center frame 105 at the front side, and the projections to be supported 228 formed on the front wall 203 of the developing frame 36 is butted against the support roller 110 of the center frame 105 thereby to be supported. In this manner, the developing cartridge 27 is positioned with respect to the drum sub-unit 28, and thus, mounting of the developing cartridge 27 to the drum sub-unit 28 is achieved.

After the developing cartridge 27 has been mounted in this manner, the fingers are released from the handle 214 in the erected state, and the handle 214 is tilted around the support shaft 233 under its own weight from the erected state to the tilted state.

When all the developing cartridges 27 have been mounted to the drum sub-units 28, the front side gripping part 111 of the front beam 101, the handles 214 of the respective developing cartridges 27, and the rear side gripping part 113 of the rear beam 102 is arranged so as to be superposed in the front-rear direction, as shown in FIG. 3.

On the other hand, by gripping the handle 214 in the state where the developing cartridge 27 has been mounted to the drum unit 26 (the drum sub-unit 28), the handle 214 is pulled up from the tilted state to the erected state, and is lifted upward, whereby the developing cartridge 27 can be detached from the drum unit 26.

4. Rail, Separating and Pressing Mechanism

Figure 15:
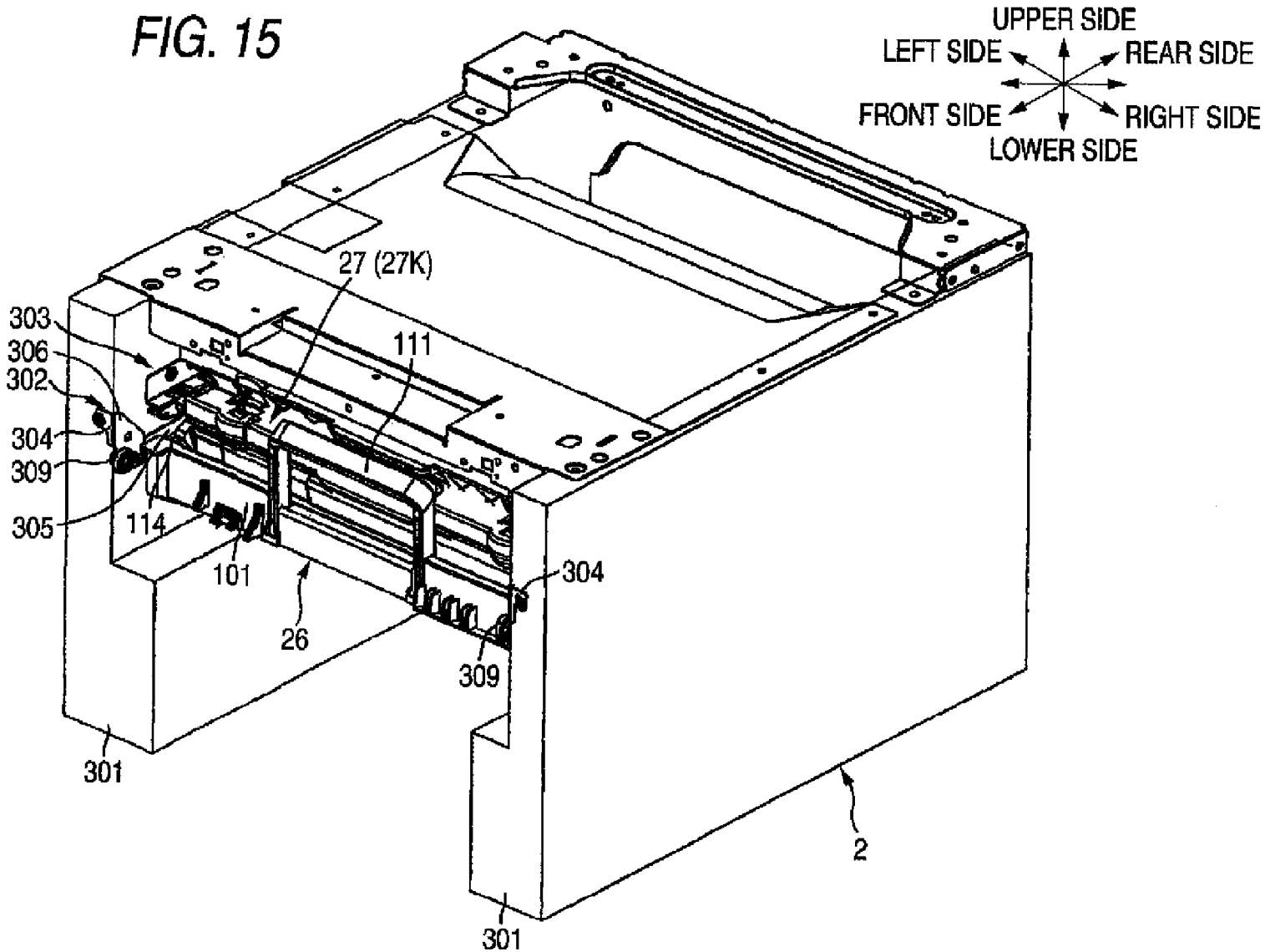
FIG. 15 is a perspective view of a body casing and a drum unit shown in FIG. 1, as seen from above at a right front side, in a state where an exterior board and a front cover of the body casing are removed and the drum unit is mounted to the body casing.

FIG. 15 is a perspective view of the body casing 2 and the drum unit 26 as seen from above at a right front side, showing a state where an exterior board and the front cover 9 of the body casing 2 have been removed, and the drum unit 26 has been mounted to the body casing 2.

The body casing 2 has a pair of body frames 301 which are opposed to each other in the width direction interposing the drum unit 26. Rails 302 for guiding mounting and dismounting of the drum unit 26, and a separating and pressing mechanism 303 are respectively provided on inner side faces of the body frames 301. The separating and pressing mechanism 303 is provided for the purpose of separating and pressing the developing rollers 39 of the developing cartridges 27 which have been mounted to the drum unit 26 with respect to the photosensitive drums 29, (for the purpose of moving the developing cartridges 27 between a contact position and a separated position, and further pressing the developing cartridges 27 against the photosensitive drums 29 in the contact position).

It should be noted that the separating and pressing mechanism 303 at the left side only is shown in FIG. 15.

Figure 16:
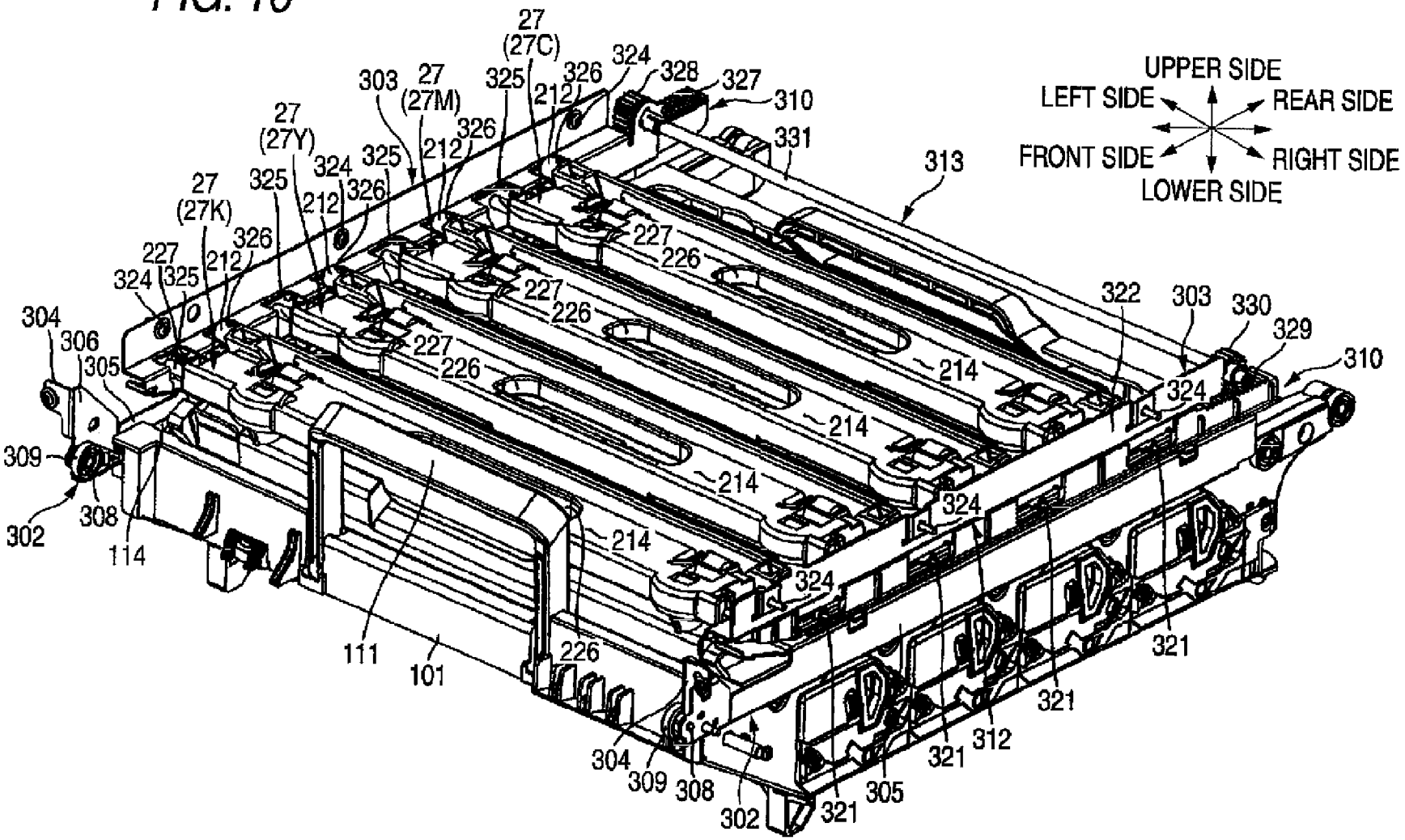
FIG. 16 is a perspective view of the drum unit, right and left rails, and a separating and pressing mechanism shown in FIG. 15, as seen from above at a right front side.
Figure 17:
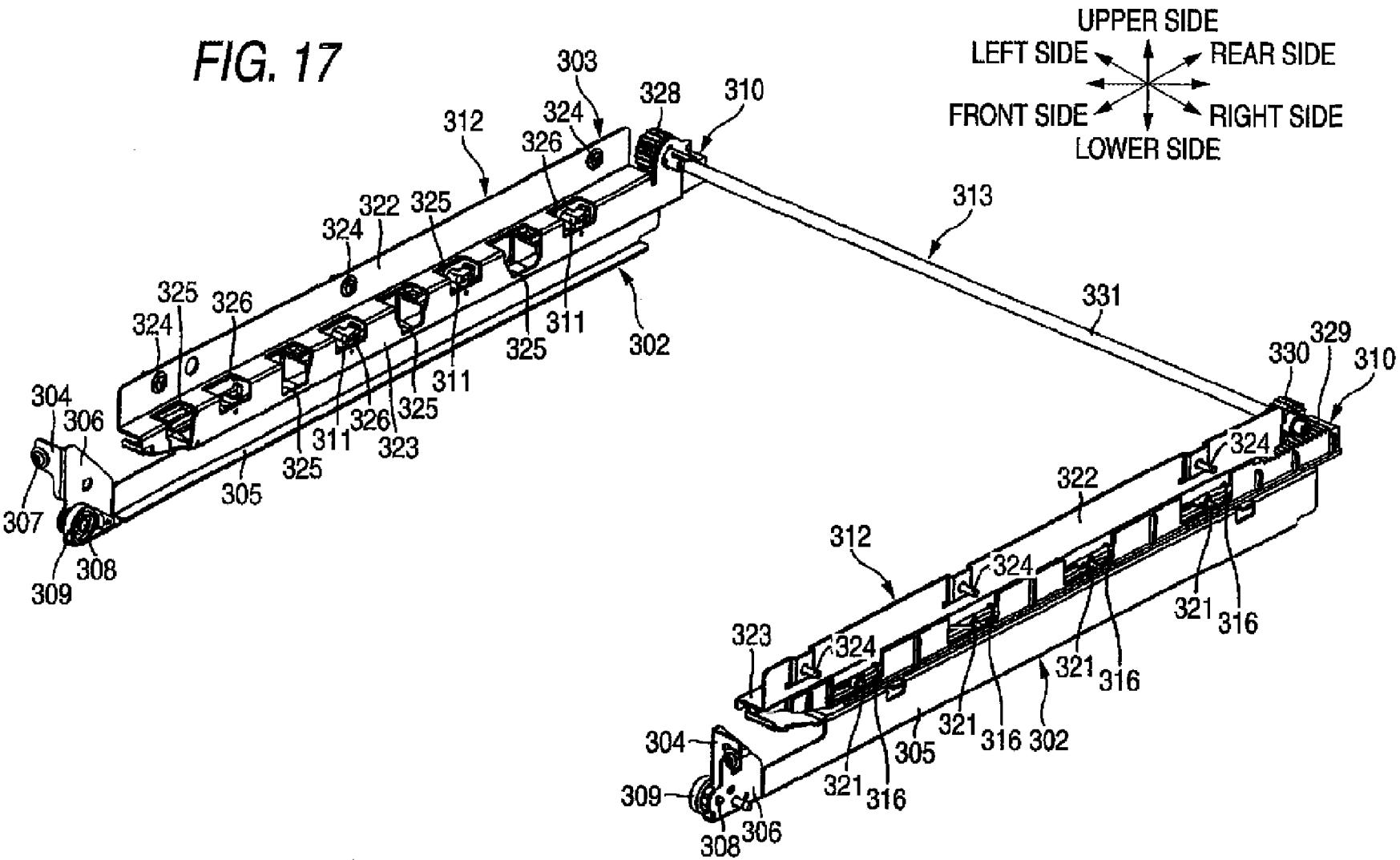
FIG. 17 is a perspective view of the rails, and the separating and pressing mechanism shown in FIG. 15, as seen from above at a right front side.

FIG. 16 is a perspective view of the drum unit 26, the right and left rails 302, and the right and left separating and pressing mechanisms 303, as seen from above at the right front side. FIG. 17 is a perspective view of the right and left rails 302 and the right and left separating and pressing mechanisms 303, as seen from above at the right front side.

(1) Rails

The right and left rails 302 are arranged so as to be opposed to each other in the width direction, interposing the drum unit 26. Each of the rails 302 integrally has a rail securing part 304 opposed to a front end face of the body frame 301, a rail body part 305 extending in the front-rear (a horizontal direction) along the inner side face of the body frame 301, and a connecting part 306 which connects the rail securing part 304 to the rail body part 305.

The rail securing part 304 is fixed to the front end face of the body frame 301 with a screw 307. The rail body part 305 is formed in a substantially L-shape in cross section having its lower end portion folded inward in the width direction. In a state where the drum unit 26 has been mounted to the casing 2, the flange portion 114 of the side plate 103 of the drum unit 26 is placed on a horizontally extending portion of the rail body part 305.

The connecting part 306 is so formed as to connect an end edge of the rail securing part 304 at an inner side in the width direction to a front end edge of the rail body part 305. The connecting part 306 is provided with a roll support shaft 308 which passes it through in the width direction. A rail roll 309 which is rotatably held by the roll support shaft 308 is provided so as to be opposed to an inner face of the connecting part 306 in the width direction. The uppermost portion of a peripheral face of the rail roll 309 is positioned higher than the lower end portion (the horizontally extending portion) of the rail body part 305.

(2) Mounting of the Drum Unit 26 to the Body Casing

In order to mount the drum unit 26 to the body casing 2, the front side gripping part 111 and the rear side gripping part 113 (See FIG. 3) of the drum unit 26 is respectively gripped with both hands, as a first step, thereby to lift the drum unit 26. Then, the front cover 9 is tilted to open the mounting hole 8 as shown in FIG. 1, and the drum unit 26 is inserted into the drum containing space 7 from the mounting hole 8.

On this occasion, the roll members 118 provided in the rear end part of the drum unit 26 is rolled along the rail body parts 305 of the rails 302. Then, releasing the hand from the rear side gripping part 113, the two flange portions 114 of the drum unit 26 are respectively placed on the right and left rail rolls 309. In this state, the drum unit 26 is pushed rearward. Consequently, the roll members 118 will roll along the rail body parts 305, and the flange portions 114 will slide along the rail rolls 309, whereby the drum unit 26 is smoothly moved. At the same time, the separating projections 212 and the pressing projections 227 of the developing cartridges 27 will slide along cam receiving parts 323 of holder securing parts 322, which will be described below.

Then, the roll members 118 will fall rearward from the rails 302, and the flange portions 114 will fall rearward from the rail rolls 309 to be placed on the horizontally extending portions of the rail body parts 305. Consequently, the pressing projections 227 and the separating projections 212 of the developing cartridges 27 are respectively received in pressing projection receiving parts 325 and separating projection receiving parts 326 which will be described below, whereby mounting of the drum unit 26 to the body casing 2 is completed.

Thereafter, releasing the hand from the front side gripping part 111, the front cover 9 is closed, and the mounting hole 8 is closed by the front cover 9. In association with the closing motion of the front cover 9, the front side gripping part 111 is rotated around the support shaft 112 from the erected position (See FIG. 4) to the stored position (See FIG. 3).

(3) Separating and Pressing Mechanism

As shown in FIG. 17, the separating and pressing mechanism 303 includes a pair of linear movement cam members 310, intermediate members 311 respectively provided relative to the linear movement cam members 310, cam holders 312 which hold the linear movement cam members 310 so as to rectilinearly move in the front-rear, and a synchronous movement mechanism 313 for rectilinearly moving the pair of linear movement cam members 310 synchronously.

Figure 18:
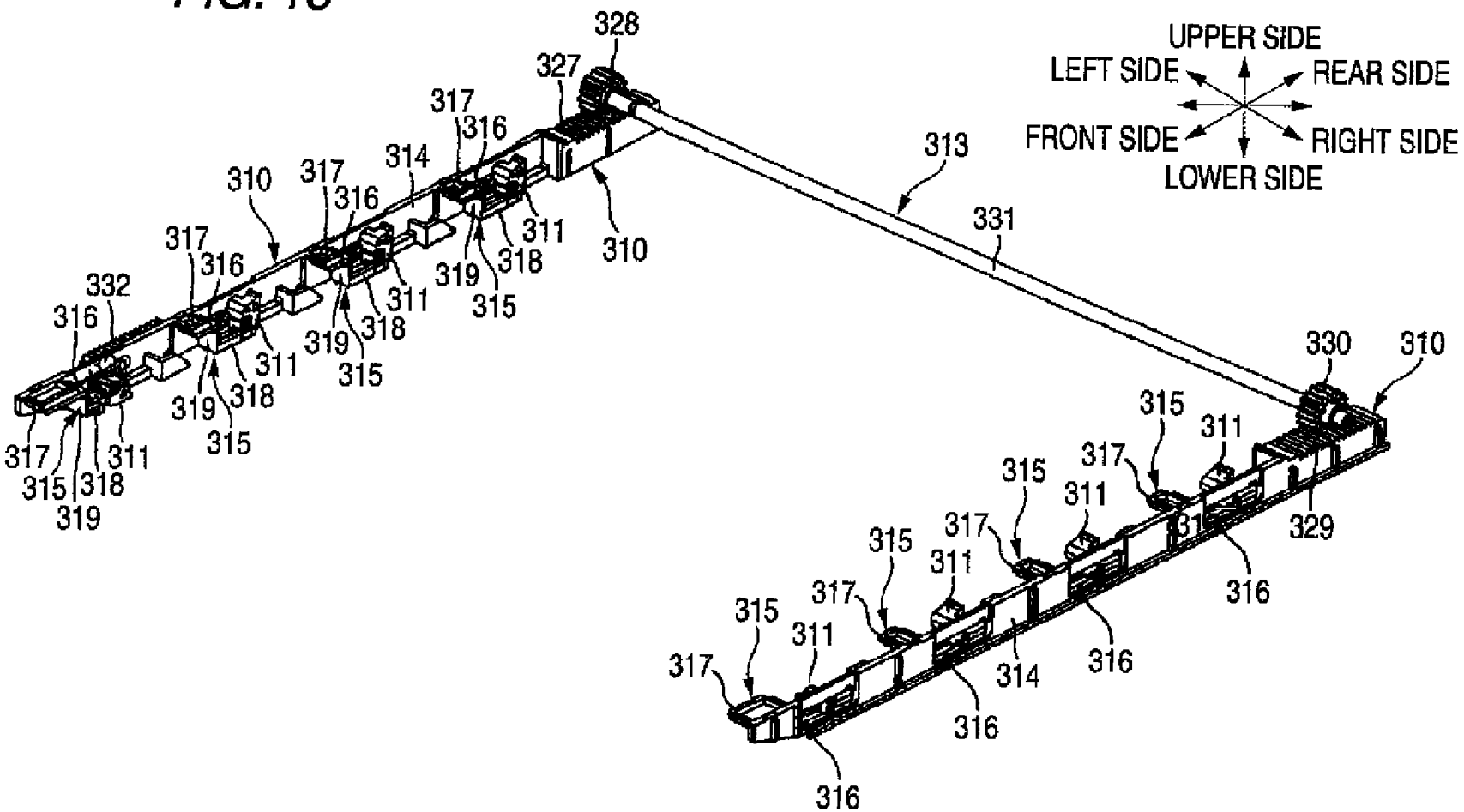
FIG. 18 is a perspective view of linear movement cam members, intermediate members, and synchronous movement mechanism shown in FIG. 17, as seen from above at a right front side.
Figures 19A, 19B, 19C, 19D, 19E:
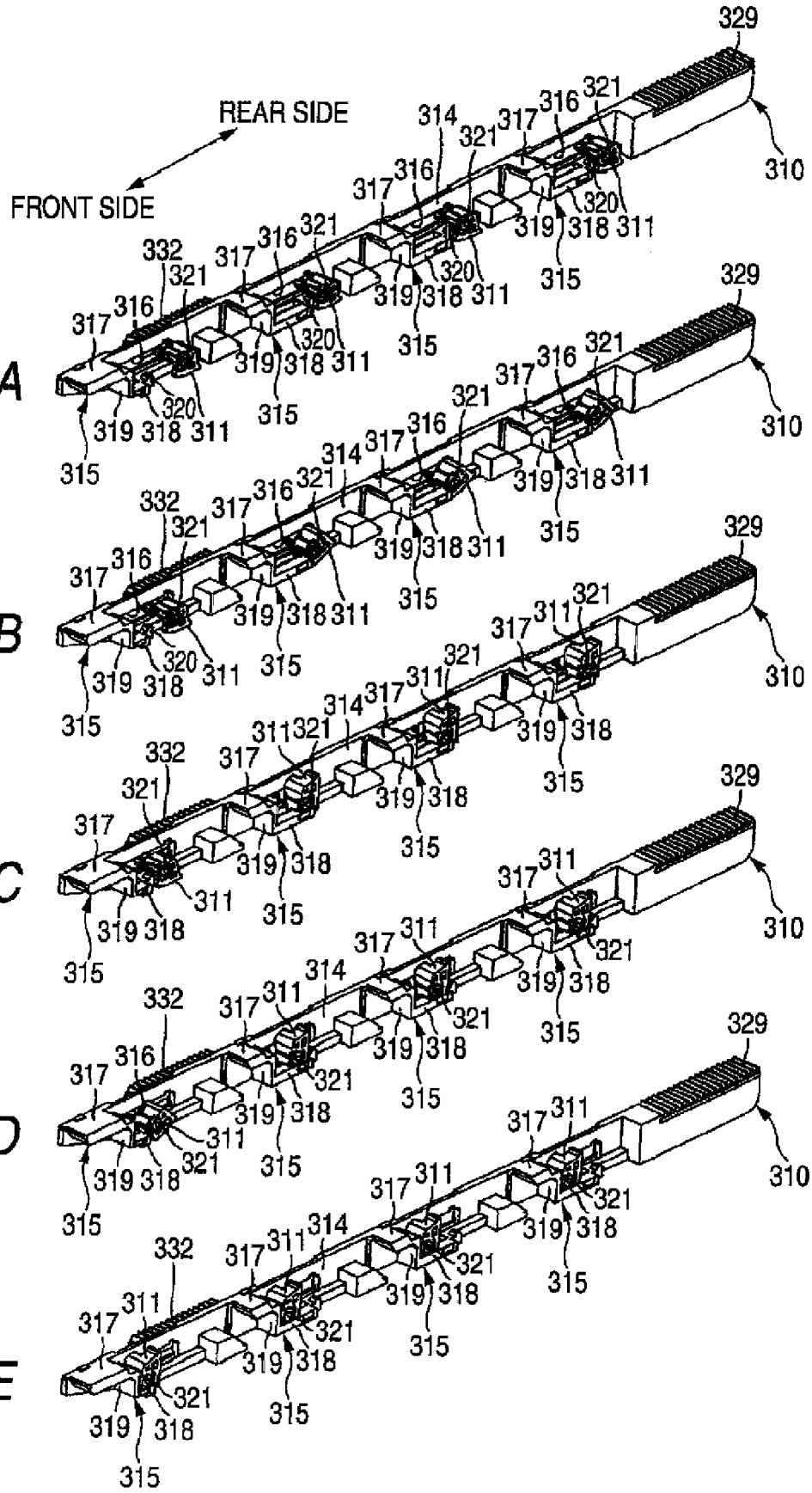
FIGS. 19A to 19E are perspective views for explaining movements of the linear movement cam member and the intermediate members, shown in FIG. 18.
Figure 20:
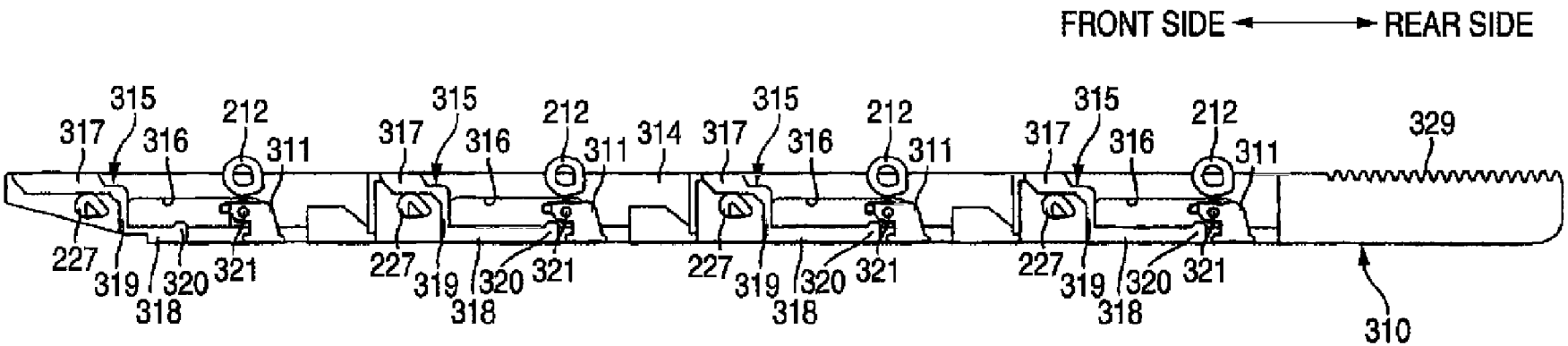
FIG. 20 is a right side view of the linear movement cam member and the intermediate members in a state of FIG. 19A.
Figure 21:
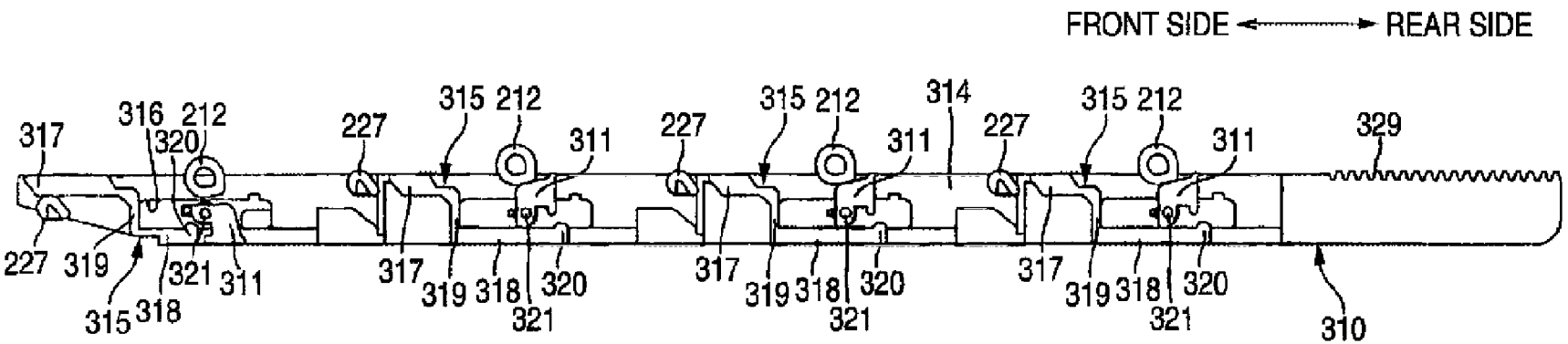
FIG. 21 is a right side view of the linear movement cam member and the intermediate members in a state of FIG. 19C.
Figure 22:
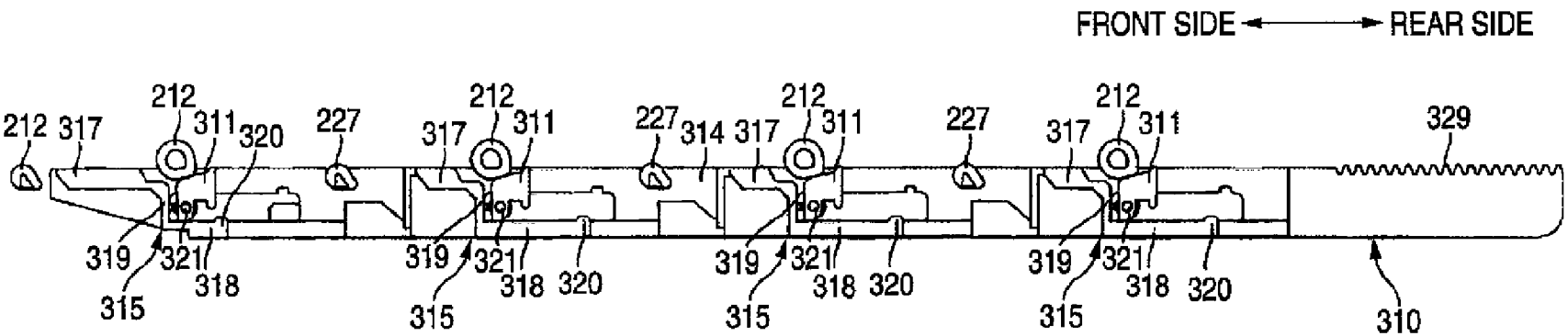
FIG. 22 is a right side view of the linear movement cam member and the intermediate members in a state of FIG. 19E.

FIG. 18 is a perspective view of the linear movement cam members 310, the intermediate members 311, and the synchronous movement mechanism 313 as seen from above at a right front side. Specifically, in FIG. 18, the cam holders 312 are omitted to show the perspective view of the separating and pressing mechanism 303 as seen from the above at the right front side. FIGS. 19A to 19E are perspective views for illustrating movements of one of the linear movement cam members 310 and the intermediate members 311. FIG. 20 is a right side view of the linear movement cam member 310 and the intermediate members 311 in a state of FIG. 19A, FIG. 21 is a right side view of the linear movement cam member 310 and the intermediate members 311 in a state of FIG. 19C, and FIG. 22 is a right side view of the linear movement cam member 310 and the intermediate members 311 in a state of FIG. 19E.

Each of the linear movement cam members 310 includes a cam body plate 314 extending along the inner side face of the body frame 301 (See FIG. 15) in the front-rear, and four operating members 315 which are provided on the inner side faces in the width direction of the cam body plate 314.

Four openings 316 in a substantially rectangular shape elongated in the front-rear are formed in the cam body plate 314 at equal intervals in the front-rear.

The four operating members 315 are respectively arranged forward of the four rectangular openings 316. Each of the operating members 315 is formed in a shape of crank in a side view, and integrally has a pressing portion 317 extending along an upper end edge of the cam body plate 314 for pressing the pressing projection 227 of the developing cartridge 27 downward, a separating portion 318 extending along a lower end edge of the cam body plate 314 for rotating the intermediate member 311, as described below, and a connecting portion 319 which connects a rearward end of the pressing portion 317 to a forward end of the separating portion 318.

As shown in FIGS. 20 to 22, a projected part 320 as an operating part projected upward is formed at the rearward end of the separating portion 318.

The most forward operating member 315 has a different shape from the other three operating members 315 (hereinafter referred to as the three rearward operating members 315). Specifically, the pressing portion 317 of the most forward operating member 315 is formed longer in the front-rear, as compared with those of the three rearward operating members 315. On the other hand, the separating portion 318 of the most forward operating member 315 is formed shorter in the front-rear, as compared with those of the three rearward operating members 315. According to such difference in shape (size), it is possible to press the developing rollers 39 of all the developing cartridges 27 against all the photosensitive drums 29, or to press the developing roller 39 of only the black developing cartridge 27K against the photosensitive drum 29, and further, to separate the developing rollers 39 of all the developing cartridges 27 from the photosensitive drums 29, as described below.

The four intermediate members 311 are respectively disposed in rear of the four operating members 315 and opposed to the four rectangular openings 316 in the width direction. As shown in FIGS. 20 to 22, each of the intermediate members 311 are formed in a substantially L-shape in a side view like a block having a thickness in the width direction. An intermediate member support shaft 321 passes one end part of the intermediate member 311 in the width direction, so that the intermediate member 311 is rotatably supported by this intermediate support shaft 321. A lower end part of the intermediate member 311 is opposed to the projected part 320 of the separating portion 318 leaving a space in the front-rear, in a state where the intermediate member 311 is not in contact with the separating portion 318 (See FIG. 20).

The four intermediate member support shafts 321 are arranged at equal intervals in the front-rear (the same intervals as the intervals of the separating projections 212 in a state where the four developing cartridges 27 have been mounted to the drum unit 26), as shown in FIG. 17. When the intermediate members 311 which are supported by the intermediate member support shafts 321 have been inserted into the corresponding rectangular openings 316, the intermediate member support shafts 321 extend in the width direction of the cam body plate 314, and inward ends in the width direction of the intermediate member support shafts 321 are supported by the cam holder 312 so as not to rotate.

As shown in FIG. 17, the cam holder 312 integrally has the holder securing part 322 in a shape of thin plate extending in the front-rear along the inner side face of the body frame 301, and the cam receiving part 323 continued from a lower end edge of the holder securing part 322.

The holder securing part 322 is fixed to the inner side face of the body frame 301 with screws 324.

The cam receiving part 323 is formed in a substantially C-shape in cross section extending inwardly in the width direction from the lower end edge of the holder securing part 322 along an entire length thereof, then, bent downwardly, and further bent outwardly in the width direction. By cutting away the cam receiving part 323 from its upper face to its inner side face continuously, four pressing projection receiving parts 325 which can receive the pressing projections 227 of the developing cartridges 27, and four separating projection receiving parts 326 which can receive the separating projections 212 of the developing cartridges 27 are alternately formed. Specifically, the four pressing projection receiving parts 325 are formed in the cam receiving part 323 at the same intervals in the front-rear as the intervals of the pressing projections 227 in the state where the developing cartridges 27 have been mounted to the drum unit 26. In the same manner, the four separating projection receiving parts 325 are formed in the cam receiving part 323 at the same intervals in the front-rear as the intervals of the separating projections 227 in the state where the developing cartridges 27 have been mounted to the drum unit 26. The separating projection receiving parts 326 are respectively arranged in rear of the pressing projection receiving parts 325. When the separating projections 212 have been respectively received in the separating projection receiving parts 326, the separating projections 212 are respectively opposed to the intermediate members 311 from above.

The synchronous movement mechanism 313 is so constructed that a driving force for linear movement can be transmitted from the left side linear movement cam member 310 to the right side linear movement cam member 310, following the linear movement of the left side linear movement cam member 310. Specifically, as shown in FIG. 18, the synchronous movement mechanism 313 includes a left side rack gear 327 which is formed on an upper face of a rearward end of the left side linear movement cam member 310, a left side pinion gear 328 which is meshed with the left side rack gear 327, a right side rack gear 329 which is formed on an upper face of a rearward end of the right side linear movement cam member 310, a right side pinion gear 330 which is meshed with the right side rack gear 329, and a connecting shaft 331 to which the left side pinion gear 328 and the right side pinion gear 330 are fixed so as not to relatively rotate.

(4) Separating and Pressing Operation

Referring now to FIGS. 19A to 22, operation of the separating and pressing mechanism 303 will be described.

As shown in FIGS. 19A and 20, in a state where the linear movement cam member 310 has been moved to the most forward pressing position, the separating portions 318 of the operating members 315 are opposed to the intermediate members 311 which are arranged in rear of the separating portions 318, in a non-contact manner spaced in the front-rear. A larger interval is formed between the separating portion 318 of the most forward operating member 315 and the intermediate member 311 arranged behind it than between the separating portions 318 of the three rearward operating members 315 and the intermediate members 311 respectively arranged behind them.

In this state, the developing cartridges 27 are in contact positions in which the developing rollers 39 are respectively in contact with the photosensitive drums 29. The pressing portions 317 of the operating members 315 are butted against the pressing projections 227 of the developing cartridges 27 from above thereby to press the pressing projections 227 downward. In each of the developing cartridges 27, by pressing the pressing projections 227 downward, the handle 214 is rotated around the support shaft 233 into the pressed state, as shown in FIG. 14, and the contact members 217 are pushed down by the handle 214 (the recesses 225) thereby to contract the coil springs 218. Urging forces of the coil springs 218 due to this contraction are applied to the upper wall 202 of the developing frame 36, and the developing frame 36 is urged downwardly, whereby the developing roller 39 is pressed against the photosensitive drum 29. At this moment, the coil springs 218 will generate the urging forces from 1N to 20N.

When the left side linear movement cam member 310 is moved rearward from this state, the left side pinion gear 328 is rotated with this movement of the left side linear movement cam member 310. This rotation of the left side pinion gear 328 is transmitted to the right side pinion gear 330 by way of the connecting shaft 331, and the right side pinion gear 330 is rotated in the same direction as the left side pinion gear 328, whereby the right side linear movement cam member 310 is moved rearward.

As the rearward movement of the linear movement cam member 310 proceeds, the pressing portions 317 of the three rearward operating members 315 are released from engagement with the pressing projections 227 of the developing cartridges 27, and therefore, pressure on the pressing projections 227 by the pressing portions 317 are removed. Then, as shown in FIG. 19B, the separating portions 318 of the three rearward operating members 315 are butted against the lower end parts of the intermediate members 311 which are respectively arranged in rear of them, and press the lower end parts of the intermediate members 311 rearward, whereby the intermediate members 311 are rotated around the intermediate member support shafts 321 to be lifted upward. During this rotation, the intermediate members 311 are butted against the separating projections 212 which are respectively positioned above them, from below. Because the forces in an upward direction are applied from the intermediate members 311 to the separating projections 212, the yellow developing cartridge 27Y, the magenta developing cartridge 27M and the cyan developing cartridge 27C is lifted upward.

As the rearward movement of the linear movement cam member 310 further proceeds, the one end parts of the intermediate members 311 (the end parts through which the intermediate member support shafts 321 are passed) are butted against the upper faces of the separating portions 318 of the three rearward operating members 315, as shown in FIGS. 19C and 21. Then, the yellow developing cartridge 27Y, the magenta developing cartridge 27M and the cyan developing cartridge 27C is positioned at the separated positions, whereby the developing rollers 39 of the yellow developing cartridge 27Y, the magenta developing cartridge 27M and the cyan developing cartridge 27C is separated from the photosensitive drums 29. On this occasion, the pressing projections 227 of the black developing cartridge 27K are pressed by the pressing portions 317 of the operating members 315. In this manner, the developing roller 39 of only the black developing cartridge 27K is kept pressed against the photosensitive drum 29.

Thereafter, as the rearward movement of the linear movement cam member 310 further proceeds, the pressing portion 317 of the most forward operating member 315 is released from engagement with the pressing projection 227 of the black developing cartridge 27K, and pressure against the pressing projection 227 by the pressing portion 317 is removed. Then, as shown in FIG. 19D, the separating portion 318 of the most forward operating member 315 is butted against the lower end part of the intermediate member 311 which is arranged behind it, and press the lower end part of the intermediate member 311 rearward, whereby the intermediate member 311 is rotated around the intermediate member support shaft 321 to be lifted upward. During this rotation of the intermediate member 311, the intermediate member 311 is butted against the separating projection 212 which is positioned above it, from below. Because the force in an upward direction is applied from the intermediate member 311 to the separating projection 212, the black developing cartridge 27K is lifted upward.

As the rearward movement of the linear movement cam member 310 further proceeds, the one end part of the intermediate member 311 (the end part through which the intermediate member support shaft 321 is passed) is butted against the upper face of the separating portion 318 of the most forward operating member 315, as shown in FIGS. 19E and 22. Then, the black developing cartridge 27K is moved to the separated position, whereby the developing roller 39 of the black developing cartridge 27K is separated from the photosensitive drum 29. In this manner, the developing rollers 39 of all the developing cartridges 27 are in the state separated from the photosensitive drums 29.

It should be noted that by moving the linear movement cam member 310 forward from the state in FIG. 19E, the states respectively shown in FIGS. 19A to 19D can be recovered. On this occasion, the projected parts 320 of the respective separating portions 318 are engaged with the intermediate members 311, thereby to rotate the intermediate members 311 in a direction of moving apart from the separating projections 212 (downward).

5. Drive Mechanism of the Linear Movement Cam Member

Figure 23:
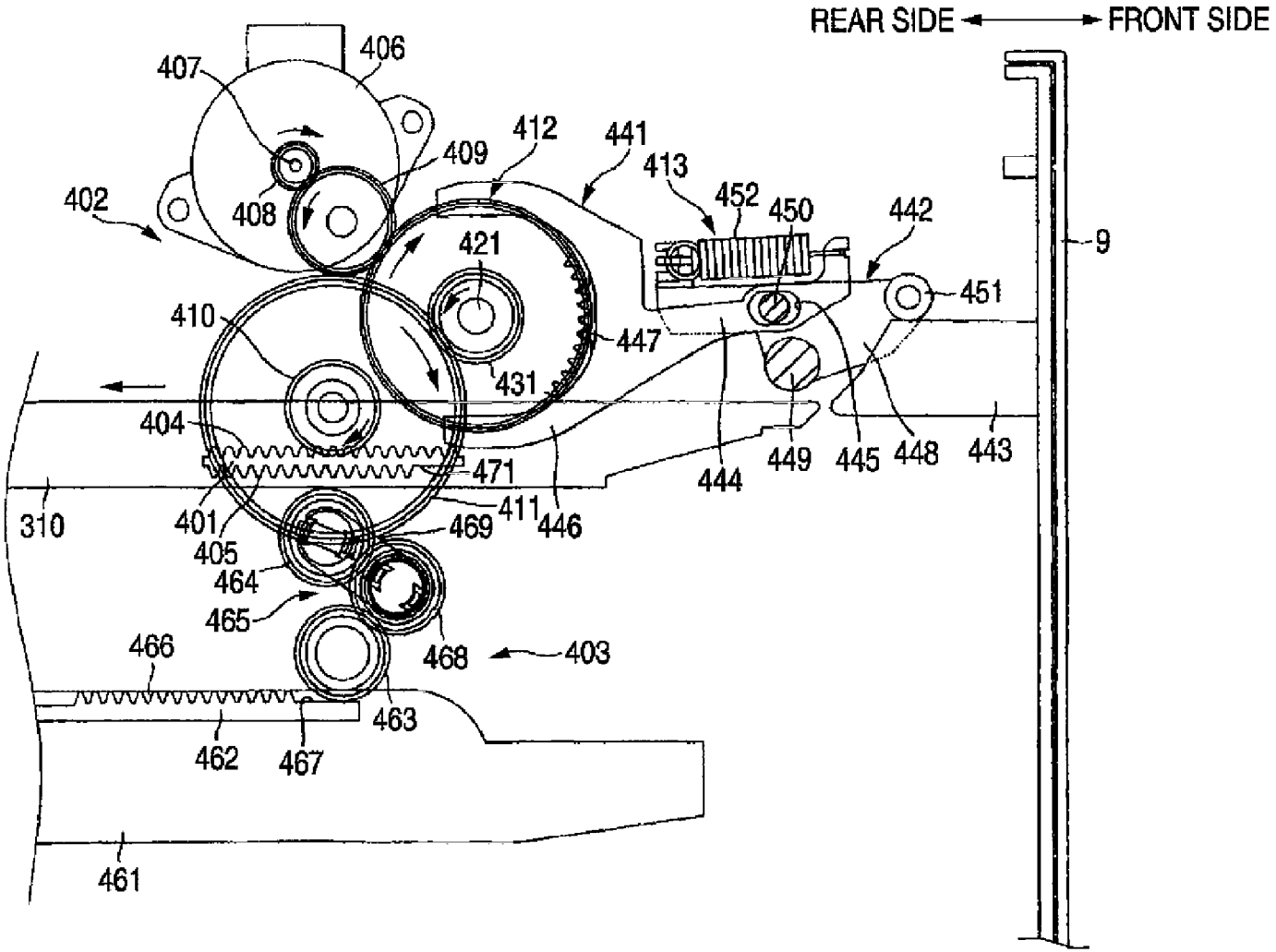
FIG. 23 is a schematic left side view of a driving mechanism for moving the linear movement cam member between a pressing position and a releasing position, in a state where a front cover is closed.
Figure 24:
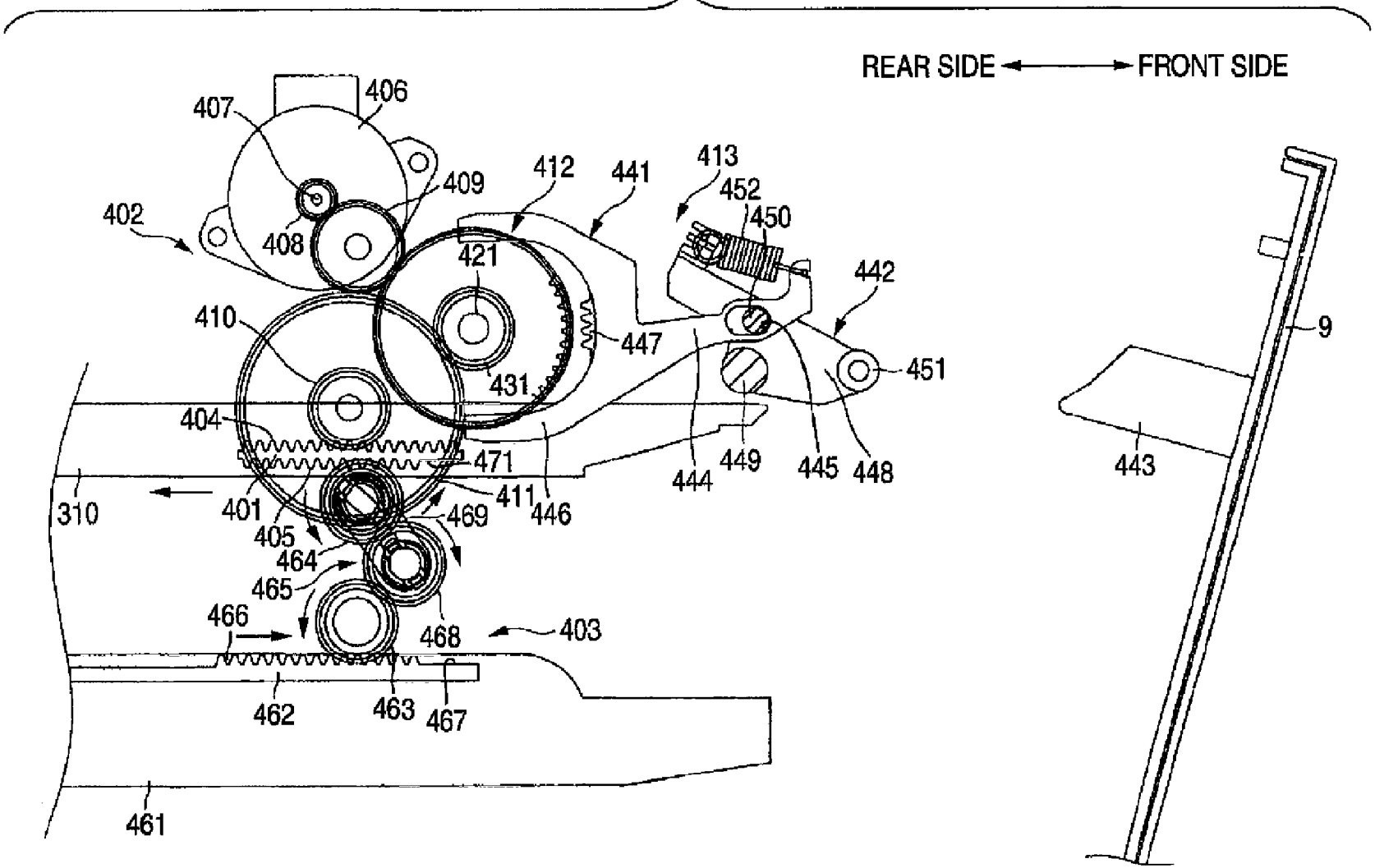
FIG. 24 is a schematic left side view of the driving mechanism for moving the linear movement cam member between the pressing position and the releasing position, in a state where the front cover is being opened.
Figure 25:
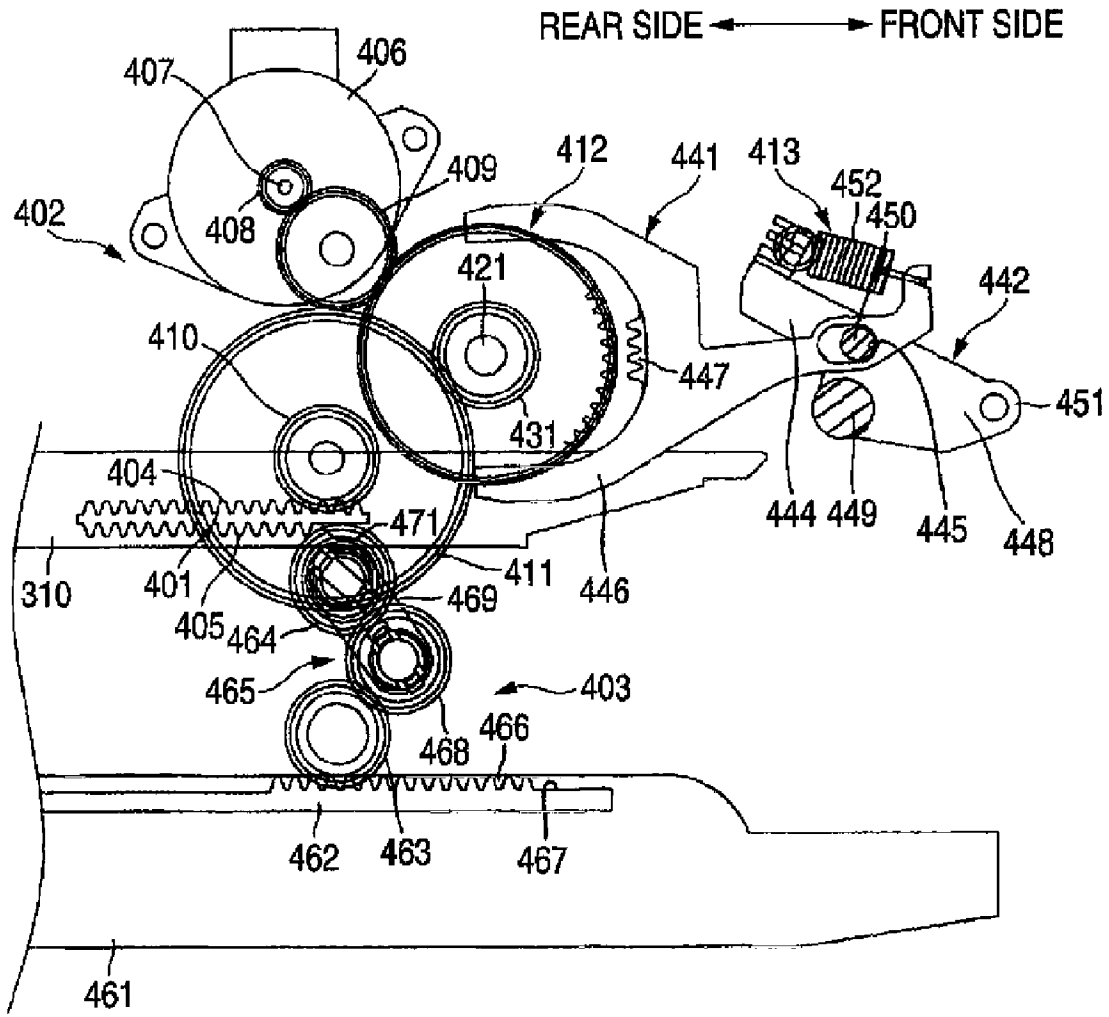
FIG. 25 is a schematic left side view of the driving mechanism for moving the linear movement cam member between the pressing position and the releasing position, in a state where the front cover is opened.

FIGS. 23, 24 and 25 are left side views schematically showing a drive mechanism for moving the linear movement cam member 310 between the pressing position and the releasing position.

The drive mechanism for moving the linear cam member 310 between the pressing position (See FIGS. 19A and 20) and the releasing position (See FIGS. 19E and 22) includes a drive input member 401 which is integrally provided on an outer side face in the width direction of the left side linear movement cam member 310, a motor driving mechanism 402 which is disposed above the drive input member 401, and a cover driving mechanism 403 which is disposed below the drive input member 401.

The drive input member 401 is formed in a substantially rectangular shape in a plan view extending in the front-rear. A first rack gear 404 to which a driving force from the motor driving mechanism 402 is inputted is formed on an upper face of the drive input member 401. The first rack gear 404 is formed along the entire length of the drive input member 401 in the front-rear. On the other hand, a second rack gear 405 to which a driving force from the cover driving mechanism 403 is inputted is formed on a lower face of the drive input member 401. The second rack gear 405 is formed on the lower face of the drive input member 401 except a forward end area of the lower face, and the forward end area is defined as an untoothed part 471 where the second rack gear 405 is not formed.

The motor driving mechanism 402 is supported by the body frame 301 at the left side. The motor driving mechanism 402 includes a motor 406 as a drive source, having its output shaft 407 arranged so as to extend in the width direction, a motor gear 408 fixed to the output shaft 407 of the motor 406, an intermediate gear 409 which is meshed with the motor gear 408, a first input smaller gear 410 which is meshed with the first rack gear 404, a first input larger gear 411 which has a larger diameter than the first input smaller gear 410 and rotates integrally with the first input smaller gear 410, a first clutch mechanism 412 capable of switching rotation of the intermediate gear 409 between a transmission state in which the rotation of the intermediate gear 409 is transmitted to the first input larger gear 411 and an interruption state in which the transmission is interrupted, and a clutch switching mechanism 413 for switching the first clutch mechanism 412 between the transmission state and the interruption state.

Figure 26:
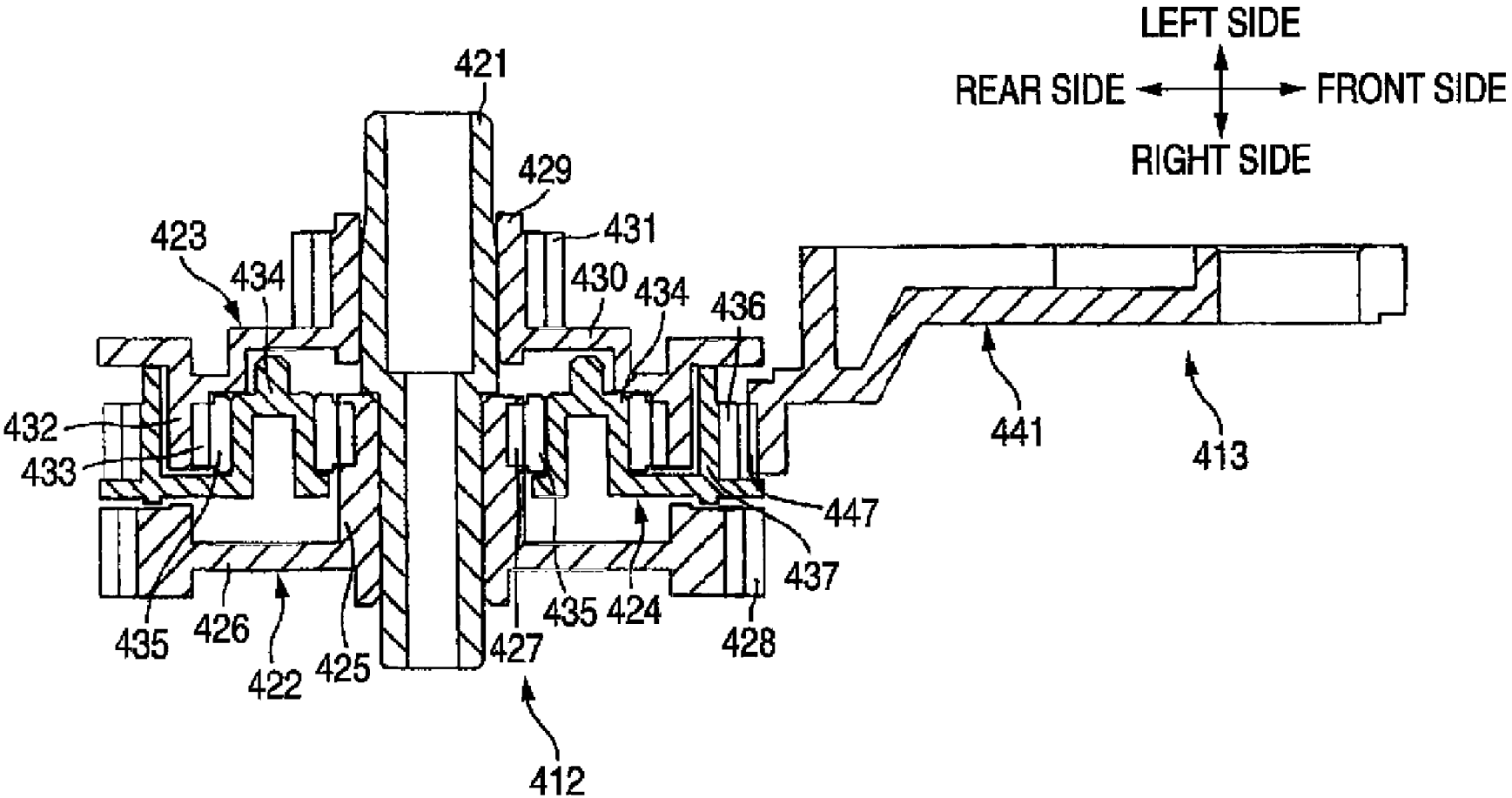
FIG. 26 is a sectional view of a first clutch mechanism shown in FIG. 23.

FIG. 26 is a sectional view of the first clutch mechanism 412.

The first clutch mechanism 412 has a structure of a so-called planetary differential clutch. Specifically, as shown in FIG. 26, the first clutch mechanism 412 includes a gear support shaft 421 extending in the width direction, and a drive input gear 422, a drive output gear 423 and a planetary gear base member 424 which are rotatably supported by the gear support shaft 421.

The drive input gear 422 is rotatably held on a right end part of the gear support shaft 421. The drive input gear 422 integrally has a cylindrical gear boss portion 425 inserted over the gear support shaft 421, and a protruded portion 426 having a round shape in a side view which is protruded in a radial direction from a right end part of the gear boss portion 425.

A sun gear portion 427 which is meshed with planetary gears 435, which will be described below, is formed on an outer peripheral face of the gear boss portion 425 at a left end part thereof.

A circumferential edge of the protruded portion 426 has a thickness in the width direction, and an input gear portion 428 to be meshed with the intermediate gear 409 (See FIG. 23) is formed on an outer peripheral face of the protruded portion 426.

The drive output gear 423 is rotatably held on a left end part of the gear support shaft 421, and spaced from the drive input gear 422 in the width direction. The drive output gear 423 integrally has a cylindrical gear boss portion 429 inserted over the gear support shaft 421, and a protruded portion 430 having a round shape in a side view which is protruded in a radial direction from a right end of the gear boss portion 429.

An output gear portion 431 which is meshed with the first input larger gear 411 is formed on an outer peripheral face of the gear boss portion 429 at a left end part thereof.

A cylindrical portion 432 projecting toward the drive input gear 422 is formed on a right side face of the protruded portion 430 in the middle in a radial direction thereof. The cylindrical portion 432 is formed in a cylindrical shape surrounding the gear support shaft 421, and opposed to the sun gear portion 427 of the drive input gear 422. An inner gear portion 433 which is meshed with the planetary gears 435, which will be described below, is formed on an inner peripheral face (a face opposed to the sun gear portion 427) of the cylindrical portion 432.

The planetary gear base member 424 is arranged between the drive input gear 422 and the drive output gear 423 so as to rotate around the gear support shaft 421. This planetary gear base member 424 has a round shape in a side view.

A plurality of planetary gear support portions 434 are integrally formed on the planetary gear base member 424 circumferentially around the gear support shaft 421. Each of the planetary gear support portions 434 is formed as a protuberance having a substantially C-shape in cross section which is open to the right side and protruded to the left side (toward the drive output gear 423). The planetary gears 435 are respectively supported by the planetary gear support portions 434 so as to rotate (rotate on their own axes), and are meshed with the sun gear portion 427 of the drive input gear 422 and the inner gear portion 433 of the drive output gear 423.

At a circumferential edge of the planetary gear base member 424, a gear forming portion 437 in a cylindrical shape surrounding the gear support shaft 421 is formed so as to project to the left side. A securing gear 436 to be meshed with a lock gear 447 of a clutch switching lever 441, which will be described below is formed on an outer peripheral face of the gear forming portion 437.

In a state where the lock gear 447 of the clutch switching lever 441 is locked to the securing gear 436 of the planetary gear base member 424, the rotation of the planetary gear base member 424 is restricted. Then, the rotation force is inputted from the intermediate gear 409 to the input gear portion 428 of the drive input gear 422 thereby to rotate the drive input gear 422. When the drive input gear 422 is rotated, the planetary gears 435 will rotate on their own axes without changing their positions in the circumferential direction around the gear support shaft 421. Due to the rotations of the planetary gears 435, the drive output gear 423 having the inner gear portion 433 which is meshed with the planetary gears 435 is rotated around the gear support shaft 421. Then, the rotation force of the drive output gear 423 is transmitted to the first input larger gear 411 thereby to rotate the first input larger gear 411. By the rotation of the first input larger gear 411, transmission of the rotation force of the intermediate gear 409 to the first input larger gear 411 is achieved.

On the other hand, in a state where the clutch switching lever 441 is separated from the planetary gear base member 424, the planetary gear base member 424 can be rotated around the gear support shaft 421. Accordingly, even though the rotation force of the intermediate gear 409 is inputted to the input gear portion 428 of the drive input gear 422, the drive output gear 423 will not rotate, because the planetary gears 435 will revolve around the gear support shaft 421 (the planetary gear base member 424 rotates around the gear support shaft 421), while they rotate on their own axes. To the contrary, even though the drive output gear 423 is rotated in a state where the drive input gear 422 is stopped (in a state where a brake force is exerted on the drive input gear 422 due to stop of the motor 406), the planetary gears 435 will revolve around the gear support shaft 421 (the planetary gear base member 424 rotates around the gear support shaft 422) while they rotate on their own axes, following the rotation of the drive output gear 423, provided that the clutch switching lever 441 is separated from the planetary gear base member 424. For this reason, in the state where the clutch switching lever 441 is separated from the planetary gear base member 424, there is no connection between the drive input gear 422 and the drive output gear 423, and the transmission of the rotation force of the intermediate gear 409 to the first input larger gear 411 is interrupted.

Specifically, when the lock gear 447 of the clutch switching lever 441 is locked to or separated from the securing gear 436 of the planetary gear base member 424, the first clutch mechanism 412 is switched between a transmission state in which the rotation force of the intermediate gear 409 is transmitted to the first input larger gear 411 and an interruption state in which the transmission is interrupted.

As shown in FIGS. 23 to 25, a clutch switching mechanism 413 has the clutch switching lever 441 provided in front of the first clutch mechanism 412, a lever moving mechanism 442 for moving the clutch switching lever 441 rear and forth in the front-rear, and an operating piece 443 for operating the lever moving mechanism 442 in association with opening and closing motions of the front cover 9.

The clutch switching lever 441 integrally has an arm portion 444 extending in the front-rear, and a lock portion 446 connected to a rearward end of the arm portion 444.

The arm portion 444 is formed in a substantially L-shape in a side view having its front end part bent upward. Moreover, an elongated hole 445 is formed in a center part in the front-rear of the arm portion 444 along the front-rear thereof.

The lock portion 446 is formed in a substantially C-shape in a side view which is open to the rear side, and the lock gear 447 which is meshed with the securing gear 436 of the planetary gear base member 424 is formed on a circular face of the C-shape.

The lever moving mechanism 442 has a pair of opposed pieces 448 which are opposed to each other interposing the arm portion 444 of the clutch switching lever 441, an opposed piece support shaft 449 extending in the width direction to rotataly support the pair of opposed pieces 448, a lever operating shaft 450 extending in the width direction at the middle in the front-rear of the opposed pieces 448 and inserted through the elongated hole 445 of the clutch switching lever 441, a lock boss 451 extending in the width direction between rearward ends of the opposed pieces 448 to which the operating pieces 443 is locked, and a coil spring 452 which is suspended between front ends of the opposed pieces 448 and a rearward end of the clutch switching lever 441.

It is to be noted that the opposed piece 448 at the right side only is shown in FIGS. 23 to 25, and the opposed piece 448 at the left side is omitted to simplify the drawings.

The operating piece 443 is formed in a substantially trapezoidal shape in a side view extending in the front-rear from the inner face of the front cover 9 toward a position below the lock boss 451 of the lever moving mechanism 442, in a state where the front cover 9 is closed.

The cover driving mechanism 403 is opposed to the linear movement cam member 310 from below in the vertical direction, and provided with a cover associated moving member 461 which extends in the front-rear. This cover associated moving member 461 is connected to the front cover 9 by means of a link mechanism which is not shown, and adapted to linearly move forward in association with the opening motion of the front cover 9 and to linearly move rearward in association with the closing motion of the front cover 9.

A rack gear member 462 is integrally provided on an outer side face in the width direction of the cover associated moving member 461, and a rack gear 466 is formed on an upper face of the rack gear member 462. The rack gear 466 is formed on the upper face of the rack gear member 462 except a forward end area of the upper face, and the forward end area is defined as an untoothed part 467 where the rack gear 466 is not formed.

Further, the cover drive mechanism 403 includes a pinion gear 463 which can be meshed with the rack gear 466, a second input gear 464 which can be meshed with the second rack gear 405, and a second clutch mechanism 465 which can be switched between a transmission state where rotation force of the pinion gear 463 is transmitted to the second input gear 464 and an interruption state where the transmission is interrupted.

The pinion gear 463 is in contact with the untoothed part 467 of the rack gear member 462, in the state where the front cover 9 is closed.

The second input gear 464 is provided above the pinion gear 463. In the closed state of the front cover 9, the second input gear 464 is opposed to the second rack gear 405 on the lower face of the drive input member 401 leaving a space in the vertical direction.

The second clutch mechanism 465 is arranged in front of the pinion gear 463 and the second input gear 464, and includes a rotary gear 468 which is meshed with them, and a swinging arm 469. One end of the swinging arm 469 is held on a rotation shaft of the rotary gear 468 so as to rotate with an adequate friction resistance, and the other end thereof rotatably supports the second input gear 464.

In the state where the front cover 9 is closed, the upper end edge of the operating piece 443 is butted against the lock boss 451 of the lever moving mechanism 442 from below, as shown in FIG. 23, whereby the locking boss 451 is lifted by the operating piece 443 to a position opposed to the lever operating shaft 450 in the front-rear. At this moment, the clutch switching lever 441 is positioned in the most rearward position, and the lock gear 447 is locked to the securing gear 436 of the planetary gear base member 424 in the first clutch mechanism 412. In this manner, the first clutch mechanism 412 is in the transmission state where the rotation force of the intermediate gear 409 can be transmitted to the first input larger gear 411.

Meanwhile, the second input gear 464 is opposed to the second rack gear 405 on the lower face of the drive input member 401 leaving a space in the vertical direction, and not related with the movement of the second rack gear 405 (the linear movement cam member 310).

When drive of the motor 406 is controlled in this state, and the output shaft 407 of the motor 406 is rotated in one direction (a direction as shown by an arrow mark in FIG. 23), the rotation force (driving force) is transmitted to the intermediate gear 409 by way of the motor gear 408, and further transmitted to the first input larger gear 411 by way of the first clutch mechanism 412. Then, the first input smaller gear 410 is rotated integrally with the first input larger gear 411, and the rotation force inputted from the first input smaller gear 410 to the first rack gear 404 will move the linear movement cam member 310 linearly rearward. On the other hand, when the output shaft 407 of the motor 406 is rotated in the other direction (a direction opposite to the direction as shown by the arrow mark in FIG. 23), the rotation force is inputted to the first rack gear 404 by way of the motor gear 408, the intermediate gear 409, the first clutch mechanism 412, the first input larger gear 411, and the first input smaller gear 410, whereby the linear movement cam member 310 will linearly move forward.

Due to such reciprocating linear movements of the linear movement cam member 310, the linear movement cam member 310 is moved between the pressing position and the releasing position. Accordingly, it is possible to displace the linear movement cam member 310 to the state in which all the developing rollers 39 are pressed against the photosensitive drums 29, the state in which the developing roller 39 of only the black developing cartridge 27K is pressed against the photosensitive drum 29, and the state in which all the developing rollers 39 are separated from the photosensitive drums 29.

As the front cover 9 is opened, the operating piece 443 is separated from the lock boss 451, as shown in FIG. 24. When the operating piece 443 has been separated from the lock boss 451, the pair of opposed pieces 448 are tilted around the opposed piece support shaft 449 under their own weights in a direction of lowering the lock boss 451. Consequently, the lever operating shaft 450 of the lever moving mechanism 442 is locked to a front end part of the elongated hole 445 in the clutch switching lever 441, and a force directed forward is applied to the front end part of the elongated hole 445 from the lever operating shaft 450 thereby to move the clutch switching lever 441 forward. As the results, the locking gear 447 of the clutch switching lever 441 is separated from the securing gear 436, and the first clutch mechanism 412 is in the interruption state in which the rotation force of the intermediate gear 409 to the larger first input gear 411 is interrupted.

Meanwhile, in association with the opening motion of the front cover 9, the cover associated moving member 461 will linearly move forward. Then, the pinion gear 463 is meshed with the rack gear 466 of the rack gear member 462, and is rotated counterclockwise, as shown in FIG. 24, by the movement of the rack gear 466. Due to this rotation of the pinion gear 463, the rotary gear 468 is rotated clockwise, as shown in FIG. 24. When the rotary gear 468 is rotated, the second input gear 464 meshed with the rotary gear 468 is rotated counterclockwise in FIG. 24, and the swinging arm 469 is rotated counterclockwise about a rotation shaft of the rotary gear 468, as shown in FIG. 24. Consequently, the second input gear 464 is meshed with the second rack gear 405 on the lower face of the drive input member 401, whereby the second clutch mechanism 465 is switched to the transmission state in which the rotation force of the pinion gear 463 is transmitted to the second input gear 464. Then, the rotation force of the second input gear 464 is inputted to the second rack gear 405, and the linear movement cam member 310 is moved rearward by the rotation force.

Thereafter, the front cover 9 is further opened. When the linear movement cam member 310 has been further moved rearward, in association with the opening motion, to be positioned at the releasing position, the second input gear 464 is opposed to the untoothed part 471, as shown in FIG. 25. Therefore, even though the second input gear 464 is further rotated, the rotation force will not be inputted to the second rack 405.

When the front cover 9 is closed thereafter, the cover associated moving member 461 is linearly moved rearward in association with the closing motion. As the rack gear 466 moves, the pinion gear 463 is rotated clockwise in FIG. 25. Then, the rotary gear 468 is rotated counterclockwise in FIG. 25 by the rotation force of the pinion gear 463. As the rotary gear 468 is rotated, the swinging arm 469 is rotated by the rotation force counterclockwise in FIG. 24 around the rotation shaft of the rotary gear 468, whereby the second input gear 464 is separated from the second rack gear 405 on the lower face of the drive input member 401. In this manner, the second clutch mechanism 465 is switched to the interruption state in which transmission of the rotation force of the pinion gear 463 to the second input gear 464 is interrupted.

6. Operation and Effects

According to the above described structure, while the front cover 9 is closed, it is possible to press the developing roller 39 against the photosensitive drum 29 or to release the pressure, by inputting the driving force of the motor 406 to the first rack gear 404 by way of the first input smaller gear 410 to move the linear movement cam member 310 between the pressing position and the releasing position. Moreover, because the linear movement cam member 310 is moved to the releasing position by the force inputted to the second rack gear 405 by way of the second input gear 464 in association with the opening motion of the front cover 9, pressures of all the developing rollers 39 against all the photosensitive drums 29 can be released, in the state where the front cover 9 is opened. For this reason, the developing cartridges 27 can be smoothly detached from the body casing 2.

Moreover, because the drive input member 401 having the first rack gear 404 and the second rack gear 405 is integrally provided with the linear movement cam member 310, it is possible to reliably move the linear movement cam member 310 by the force inputted to the first rack gear 404 by way of the first input smaller gear 410, and also possible to reliably move the linear movement cam member 310 by the force inputted to the second rack gear 405 by way of the second input gear 464. In this manner, pressure of the developing rollers 39 against the photosensitive drums 29 can be reliably exerted and released.

Further, transmission and interruption of the driving force from the motor 406 to the first input smaller gear 410 (the first input larger gear 411) can be switched by the first clutch mechanism 412. Therefore, it is possible to transmit the driving force from the motor 406 to the first input smaller gear 410, and to move the linear movement cam member 310 by the driving force. It is also possible to interrupt the driving force from the motor 406 to the first input gear, and to move the linear movement cam member 310 by the force which is inputted from the second input gear 464 to the second rack gear 405, irrespective of the motor 406. In other words, in case where the linear movement cam member 310 is moved by the driving force of the motor 406, the driving force is transmitted to the first input gear, and in other cases, connection between the motor 406 and the first input smaller gear 410 is interrupted, whereby it is possible to prevent the motor 406 from hindering the movement of the linear movement cam member 310.

Still further, because the first clutch mechanism 412 can be switched to the transmission state in association with the closing motion of the front cover 9, it is possible to move the linear movement cam member 310 thereafter, by the driving force of the motor 406. Moreover, because the first clutch mechanism 412 can be switched to the interruption state in association with the opening motion of the front cover 9, it is possible to move the linear movement cam member 310 thereafter, by the driving force inputted to the second rack gear 405, irrespective of the motor 406.

Further, in the first clutch mechanism 412, it is possible to reliably transmit the driving force from the motor 406 to the first input larger gear 411 which is meshed with the output gear part 431 of the drive output gear 423, in the state where the front cover 9 is closed. On the other hand, in the state where the front cover 9 is opened, it is possible to reliably interrupt the transmission of the driving force from the motor 406 to the first input larger gear 411.

Because the second input gear 464 is rotated in association with the opening motion and the closing motion of the front cover 9, it is possible to generate the rotation force of the second input gear 464 in association with the opening motion and the closing motion of the front cover 9.

Then, it is possible to switch the transmission and interruption of the rotation force of the second input gear 464 to the second rack gear 405 by the second clutch mechanism 465. In this manner, it is possible to transmit the rotation force of the second input gear 464 to the second rack gear 405 thereby to move the linear movement cam member 310. On the other hand, it is possible to input the driving force from the motor 406 to the first rack gear 404, by interrupting the transmission of the rotation force of the second input gear 464 to the second rack gear 405, thereby to move the linear movement cam member 310.

Further, during the opening motion of the front cover 9, it is possible to switch the second clutch mechanism 465 to the transmission state, and to transmit the rotation force of the second input gear 464 to the second rack gear 405 thereby to move the linear movement cam member 310. Because the linear movement cam member 310 is moved from the pressing position to the releasing position by the rotation force of the second input gear 464 at this time, the pressure of the developing rollers 39 against the photosensitive drums 29 can be reliably removed. On the other hand, because the second clutch mechanism 465 can be switched to the interruption state during the closing motion of the front cover 9, it is possible to move the linear movement cam member 310 to the pressing position and the releasing position after the closing motion of the front cover, by inputting the driving force from the motor 406 to the first rack gear 404.

Further, in the second clutch mechanism 465, the rotary gear 468 is rotated in one direction in association with the opening motion of the front cover 9, and following this rotation, the second input gear 464 is meshed with the second rack gear 405 while rotating. In this manner, it is possible to reliably transmit the rotation force of the second input gear 464 to the second rack gear 405 during the opening motion of the front cover 9. Moreover, the rotary gear 468 is rotated in the other direction in association with the closing motion of the front cover 9, and following this rotation, the second input gear 464 is separated from the second rack gear 405. In this manner, it is possible to reliably interrupt the transmission of the rotation force of the second input gear 464 to the second rack gear 405 during the closing motion of the front cover 9.

Further, it is possible to move the linear movement cam member 310 to the releasing position by the force which is inputted from the second input gear 464 to the second rack gear 405 in association with the opening motion of the front cover 9. Accordingly, in the state where the front cover 9 is opened, it is possible to reliably remove the pressure of the developing rollers 39 against the photosensitive drums 29.

Further, when the linear movement cam member 310 has been moved to the releasing position, the second input gear 464 is opposed to the untoothed part 471. Therefore, even though the second input gear 464 is rotated further, the rotation will not be inputted to the second rack gear 405. Accordingly, it is possible to prevent the linear movement cam member 310 from moving beyond the releasing position, and to prevent occurrence of troubles due to such excessive movement of the linear movement cam member 310.

What is claimed is:

1. An image forming apparatus comprising:

an image carrier on which an electrostatic latent image is formed;

a developing agent carrier which supplies developing agent to the image carrier;

a linear movement member which reciprocally and substantially linearly moves between a pressing position for pressing the developing agent carrier against the image carrier and a releasing position for releasing pressure;

a drive source;

a cover which is provided on a body of the apparatus so as to be opened and closed;

a first input member which inputs a driving force from the drive source to the linear movement member as a force for moving the linear movement member; and a second input member which inputs a force for moving the linear movement member in conjunction with an opening motion of the cover.

2. The image forming apparatus according to claim 1, wherein the linear movement member is integrally provided with a first rack gear and a second rack gear, the first input member includes a first input gear which inputs the driving force from the drive source to the first rack gear, and the second input member includes a second input gear which inputs the force for moving the linear movement member to the second rack gear.

3. The image forming apparatus according to claim 2, further comprising a first clutch mechanism capable of being switched to a transmission state in which the driving force from the drive source is transmitted to the first input gear and to an interruption state in which transmission of the driving force to the first input gear is interrupted.

4. The image forming apparatus according to claim 3, further comprising a clutch switching lever which switches the first clutch mechanism from the interruption state to the transmission state in conjunction with a closing motion of the cover and switches the first clutch mechanism from the transmission state to the interruption state in conjunction with the opening motion of the cover.

5. The image forming apparatus according to claim 4, wherein the first clutch mechanism includes:

a gear support shaft;

a drive input gear capable of rotating about the gear support shaft, the drive input gear including an input gear portion and a sun gear portion which are formed on a coaxial cylindrical face around the gear support shaft, the driving force from the drive source being inputted to the input gear portion;

a drive output gear capable of rotating about the gear support shaft, the drive output gear including an output gear portion which is formed on a cylindrical face around the gear support shaft and an inner gear portion which is formed on a cylindrical face opposed to the sun gear portion leaving a space, the first input gear being meshed with the output gear portion;

a planetary gear which is interposed between the sun gear portion and the inner gear portion and is meshed with the sun gear portion and the inner gear portion; and a planetary gear base member including a planetary gear support portion which is arranged between the drive input gear and the drive output gear and is rotatable about the gear support shaft, the planetary gear support portion rotatably supporting the planetary gear, wherein the clutch switching lever is engaged with the planetary gear base member in conjunction with the closing motion of the cover and is separated from the planetary gear base member in conjunction with the opening motion of the cover.

6. The image forming apparatus according to claim 2, wherein the second input gear rotates in conjunction with the opening motion and the closing motion of the cover.

7. The image forming apparatus according to claim 6, further comprising a second clutch mechanism capable of being switched to a transmission state, in which rotation force of the second input gear is transmitted to the second rack gear, and to an interruption state, in which transmission of the rotation force of the second input gear to the second rack gear is interrupted.

8. The image forming apparatus according to claim 7, wherein the second clutch mechanism is capable of being switched from the interruption state to the transmission state during the opening motion of the cover and being switched from the interruption state to the transmission state during the closing motion of the cover.

9. The image forming apparatus according to claim 8, wherein the second clutch mechanism includes:

a rotary gear which is meshed with the second input gear and is rotated in one direction in conjunction with the opening motion of the cover, the rotary gear being rotated in the other direction opposite to the one direction in conjunction with the closing motion of the cover; and a swinging arm which rotatably supports the second input gear and is moved, following the rotation of the rotary gear in the one direction, from a separated position in which the second input gear is separated from the second rack gear to a meshed position in which the second input gear is meshed with the second rack gear, the swinging arm being moved from the meshed position to the separated position, following the rotation of the rotary gear in the other direction.

10. The image forming apparatus according to claim 2, wherein the second input gear is meshed with the second rack gear in conjunction with the opening motion of the cover, thereby to input the force for moving the linear movement member to the releasing position to the second rack gear.

11. The image forming apparatus according to claim 10, wherein when the linear movement member is moved to the releasing position, engagement between the second input gear and the second rack gear is released.

* * * * *